US011244531B2

(12) United States Patent
Ibe et al.

(10) Patent No.: US 11,244,531 B2
(45) Date of Patent: Feb. 8, 2022

(54) AUTOMATIC VENDING MACHINE

(71) Applicant: V-SYNC CO, LTD., Tokyo (JP)

(72) Inventors: Takaya Ibe, Tokyo (JP); Takashi Hashimoto, Tokyo (JP)

(73) Assignee: V-SYNC CO., LTD., Tokyo (JP)

( * ) Notice: Subject to any disclaimer, the term of this patent is extended or adjusted under 35 U.S.C. 154(b) by 0 days.

(21) Appl. No.: 16/767,718

(22) PCT Filed: Oct. 25, 2018

(86) PCT No.: PCT/JP2018/039767
§ 371 (c)(1),
(2) Date: May 28, 2020

(87) PCT Pub. No.: WO2019/107031
PCT Pub. Date: Jun. 6, 2019

(65) Prior Publication Data

US 2021/0174630 A1 Jun. 10, 2021

(30) Foreign Application Priority Data

Nov. 30, 2017 (JP) ..... JP2017-230541
Nov. 30, 2017 (JP) ..... JP2017-230542

(51) Int. Cl.
*G07F 11/58* (2006.01)
*G07F 11/72* (2006.01)
*G07F 9/00* (2006.01)

(52) U.S. Cl.
CPC ..... *G07F 11/58* (2013.01); *G07F 9/001* (2020.05); *G07F 9/002* (2020.05); *G07F 11/72* (2013.01)

(58) Field of Classification Search
CPC ..... G07F 11/58; G07F 9/00
USPC ..... 221/2, 4, 6, 17, 20, 119, 217–218, 253
See application file for complete search history.

(56) References Cited

U.S. PATENT DOCUMENTS 8,678,232 B2 * 3/2014 Mockus ..... G07F 11/26 221/218
8,941,495 B2 * 1/2015 Wiese ..... G08B 13/08 340/568.8
2006/0208851 A1 9/2006 Tsuodoa

FOREIGN PATENT DOCUMENTS

CN 1828677 A 9/2006
CN 102117517 A 7/2011
CN 103209670 A 7/2013
CN 107301730 A 10/2017
EP 2628475 A1 8/2013
(Continued)

OTHER PUBLICATIONS

Japanese First Office Action (Notice of Reasons for Refusal) dated Oct. 8, 2019 was issued in the basic Japanese Appln. No. 2017-230541.

(Continued)

*Primary Examiner* — Gene O Crawford
*Assistant Examiner* — Ayodeji T Ojofeitimi
(74) *Attorney, Agent, or Firm* — Bacon & Thomas, PLLC

(57) ABSTRACT

An automatic vending machine includes: a belt conveyor constituting a part of a column configured to store a product, the belt conveyor being able to convey the stored product along the column, and a controller configured to control an operation of the belt conveyor. The controller acquires an amount of movement of a belt of the belt conveyor moving to convey the product. The controller calculates the number of products stored in the column, based on the acquired amount of movement of the belt.

14 Claims, 13 Drawing Sheets

(56) References Cited

FOREIGN PATENT DOCUMENTS

| | | | |
|---|---|---|---|
| JP | H09-50574 | A | 2/1997 |
| JP | 2000-322620 | A | 11/2000 |
| JP | 2000322620 | A | 11/2000 |
| JP | 2002-324267 | A | 11/2002 |
| JP | 2003-132417 | A | 5/2003 |
| JP | 2003-141622 | A | 5/2003 |
| JP | 2006-185035 | A | 7/2006 |
| JP | 2008-262249 | A | 10/2008 |
| JP | 2010-277356 | A | 12/2010 |
| JP | 2010277356 | A | 12/2010 |
| WO | WO2012050120 | A1 | 4/2012 |
| WO | WO2019029075 | A1 | 2/2019 |

OTHER PUBLICATIONS

Japanese First Office Action (Notice of Reasons for Refusal) dated Oct. 8, 2019 issued in Japanese Appln. No. 2017-230542.
Chinese First Office Action dated May 28, 2021 was issued in the corresponding Chinese patent application No. 201880077350.4.
The Partial supplementary European Search Report dated Jul. 2, 2021 was issued in the corresponding European patent Appn. No. 18883554.0.

* cited by examiner

AUTOMATIC VENDING MACHINE

TECHNICAL FIELD

The present invention relates to an automatic vending machine.

BACKGROUND ART

Automatic vending machines providing various styles of conveyance of products, such as a serpentine type vending machine and a see-though type ending machine, have been in widespread use.

Patent Literature 1 discloses a see-through type automatic vending machine. The automatic vending machine of Patent Literature 1 is configured to move products stored in columns in the front-to-back direction to a bucket unit, and move the bucket unit in the up-and-down direction to deliver the product to a take-out port.

In addition, there has been known a method of counting the inventory quantity of the products stored in the automatic vending machine by counting the number of fed products by using a sensor disposed at a product feed slot and calculating the difference between the number of fed products and the number of sold products.

With this method, when an accident occurs, for example, when the sensor reacts on taking out the product which has been fed by mistake, or when a plurality of products are dispensed in a single sale, it may not be possible to correctly count the actual inventory quantity of the products.

Patent Literature 2 discloses an automatic vending machine including shelves for disposing the products, reading members that are installed every shelf and read information of radio IC tags attached to the products, and a control member for receiving the information from the reading members and performing analysis and control. The automatic vending machine disclosed in Patent Literature 2 calculates the inventory quantity and the number of sales based on the information of the radio IC tags read by the reading member.

CITATION LIST

Patent Literature

PTL1: Japanese Patent Application Laid-Open No. 2008-262249

PTL2: Japanese Patent Application Laid-Open No. 2006-185035

SUMMARY OF INVENTION

Technical Problem

However, the automatic vending machine disclosed in Patent Literature 1 can store only the products in the same size for all the plurality of columns. Therefore, the automatic vending machine disclosed in Patent Literature 1 cannot sell products in various sizes. In addition, a so-called serpentine-type automatic vending machine needs to be designed and manufactured to have the plurality of columns for each of the products sizes to store the products in different sizes, and it is difficult to flexibly change the layout of the products after the automatic vending machine has been manufactured.

Meanwhile, the automatic vending machine disclosed in Patent Literature 2 needs to bother to attach the radio IC tags to the products, and bother to provide the reading members in shelves. Therefore, the automatic vending machine disclosed in Patent Literature 2 has a complicated configuration, and consequently cannot be easily introduced. Moreover, the automatic vending machine disclosed in Patent Literature 2 cannot count the inventory quantity of the existing products without radio IC tags, and therefore there is room for improvement for widespread use.

The present invention has been achieved in view of the above-described problem, and therefore it is desirable to provide an automatic vending machine capable of laying out products with a high flexibility and correctly counting the inventory quantity of the products.

Solution to Problem

A first aspect of the present invention provides an automatic vending machine including: a belt conveyor constituting a part of a column configured to store a product, the belt conveyor being able to convey the stored product along the column; and a controller configured to control an operation of the belt conveyor. The controller acquires an amount of movement of a belt of the belt conveyor moving to convey the product. The controller calculates the number of products stored in the column, based on the acquired amount of movement of the belt.

The belt conveyor includes a rotary encoder configured to detect an amount of rotational displacement of a motor moving the belt to convey the product. The controller acquires the amount of movement of the belt based on a detection result by the rotary encoder to calculate the number of the product stored in the column.

The belt conveyor includes a reference position sensor configured to detect whether the belt is located at a reference position. The controller calculates the number of the product stored in the column by moving the belt to the reference position based on a detection result by the reference position sensor, and acquiring the amount of movement of the belt from the reference position based on the detection result by the rotary encoder.

The belt conveyor includes a product sensor provided at its carrying-out part at which the product is carried out of the column, the product sensor being configured to detect whether the product is located at the carrying-out part. The controller calculates the number of the product stored in the column by acquiring an amount of movement of the belt from a position of the belt when the product is detected by the product sensor to the reference position.

The product sensor notifies the controller of a first detection result indicating that the product is located at the carrying-out part, and a second detection result indicating that the product is not located at the carrying-out part. The controller moves the belt in a direction opposite to a direction in which the product is conveyed to the carrying-out part until a detection result by the product sensor is changed from the first detection result to the second detection result after the product is carried out of the column at the carrying-out part.

A second aspect of the present invention provides an automatic vending machine including: a plurality of belt conveyors each of which constitutes a column configured to store a product, the belt conveyor being able to convey the stored product along the column; partition plates each of which is removably disposed between the plurality of columns to separate between the plurality of columns according to kinds of products; a communication unit configured to receive product information on the products stored in the plurality of columns from an external device; and a controller configured to control operations of the plurality of belt conveyors. The product information is accompanied by supplementary information which allows a layout of the product for the plurality of columns to be specified. The controller controls the operations of the plurality of belt conveyors, based on presence or absence of a partition plate and the supplementary information.

Each of the plurality of columns includes a partition plate sensor configured to detect whether there is the partition plate. The controller determines whether the products can be stored according to the layout specified by the supplementary information, based on a detection result by the partition plate sensor.

The controller controls the operations of the plurality of belt conveyors to allow the product stored according to the layout to be conveyed, when the product can be stored according to the layout specified by the supplementary information. The controller announces that a placement of the partition plate is to be changed when the product cannot be stored according to the layout specified by the supplementary information.

The plurality of columns are arranged along a width direction of the automatic vending machine. When a size of the product stored in one column of the plurality of columns is greater than a size of the one column in the width direction, the product is stored across the one column and a next column. The controller operates a belt conveyor of the one column and a belt conveyor of the next column in synchronization with one another to convey the product stored across the one column and the next column.

The controller determines whether the product can be stored across the one column and the next column, based on the detection result by the partition plate sensor provided between the one column and the next column. The controller determines whether the product can be stored according to the layout specified by the supplementary information, based on a result of the determination.

The controller acquires an amount of movement of a belt of the belt conveyor moving to convey the product. The controller calculates the number of product stored in the column based on the acquired amount of movement of the belt.

Accordingly, the present invention provides an automatic vending machine capable of laying out products with a high flexibility and correctly counting the inventory quantity of the products in a simple configuration.

BRIEF DESCRIPTION OF DRAWINGS

Hereinafter, the accompanying drawings for some embodiments will be described.

DESCRIPTION OF EMBODIMENTS

Hereinafter, embodiments of the present invention will be described with reference to the drawings. Note that the following embodiments illustrate some examples of the invention, and are not intended to limit the subject matter of the invention. Moreover, all the configurations and operations described in the embodiments are not necessarily essential to the invention.

With the present invention, the direction facing a user when the user operates the automatic vending machine to purchase a product is referred to as "front", and the direction opposite to the front direction is referred to as "back." In addition, with the present embodiment, the height direction of the automatic vending machine is referred to as "upper", and the direction opposite to the upward is referred to as "lower."

Embodiment 1: Configuration of Automatic Vending Machine

Figure 1:
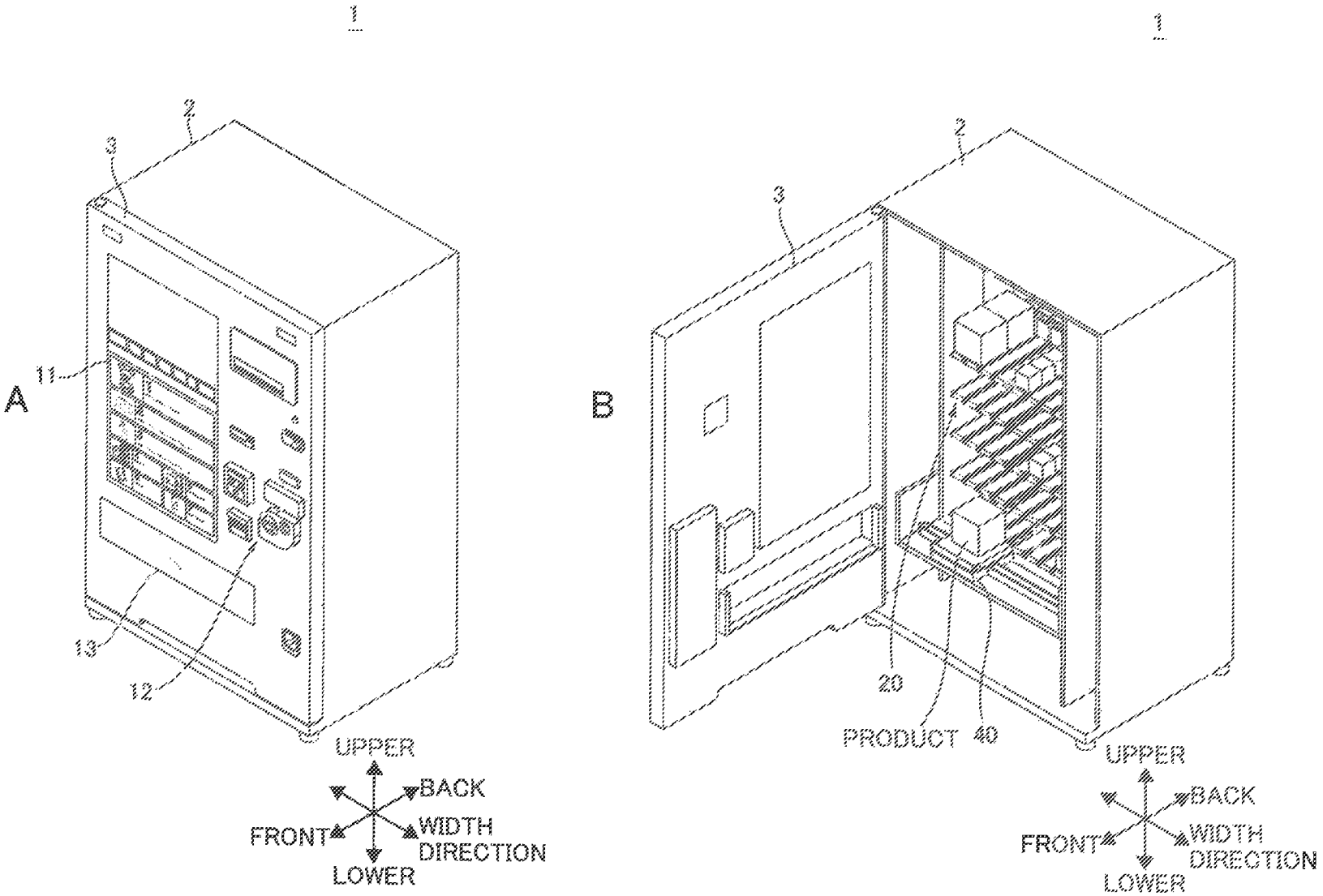
FIGS. 1A and 1B schematically illustrate the entire configuration of an automatic vending machine according to Embodiment 1 of the present invention.

FIGS. 1A and 1B schematically illustrate the configuration of an automatic vending machine 1 according to Embodiment 1 of the present invention. FIG. 1A schematically illustrates the exterior configuration of the automatic vending machine 1 according to Embodiment 1 where a door 3 of a housing 2 is closed. FIG. 1B schematically illustrates the interior configuration of the automatic vending machine 1 according to Embodiment 1 where the door 3 is open. Here, partition plates 21 described later are not illustrated in FIG. 1B.

The automatic vending machine 1 can sell various types of products. To be more specific, the automatic vending machine 1 is an unmanned vending machine configured to sell to users products as various packaged goods such as media on which contents of games and music are stored, miscellaneous goods, toys, books and food. In particular, the automatic vending machine 1 can sell products in various sizes corresponding to the sizes of the above-described goods or their packages.

The door 3 is provided on the front surface of the housing 2 of the automatic vending machine 1 as illustrated in FIG. 1A. The door 3 is opened to replenish the automatic vending machine 1 with products and collect the money paid for the products.

As illustrated in FIG. 1A, the images, the names, the kinds, the prices, and the descriptions of the products are displayed on the front surface of the door 3. Also, a display unit 11 as a touch screen to receive the operation of the user to select a product is provided on the front surface of the door 3. Moreover, a payment unit 12 including a coin mech, a bill validator, and a money reader/writer are also provided on the front surface of the door 3. When the user pays money for the product, the coin mech, the bill validator, and the money reader/writer are used to receive coins, bills and electronic money, respectively. Furthermore, a take-out port 13 from which the user takes out the purchased product is provided on the front surface of the door 3.

As illustrated in FIG. 1B, a plurality of columns 20 are provided in the automatic vending machine 1. The plurality of columns are configured to store the products sorted by kind, and arranged in the width direction and the up-and-down direction of the automatic vending machine 1. In addition, an elevator 40 is provided in the automatic vending machine 1 between the door 3 and the plurality of columns 20. The elevator 40 is configured to be able to move along the width direction and the up-and-down direction of the automatic vending machine 1 to convey the products carried out of the plurality of columns 20 to the take-out port 13.

Figure 2:
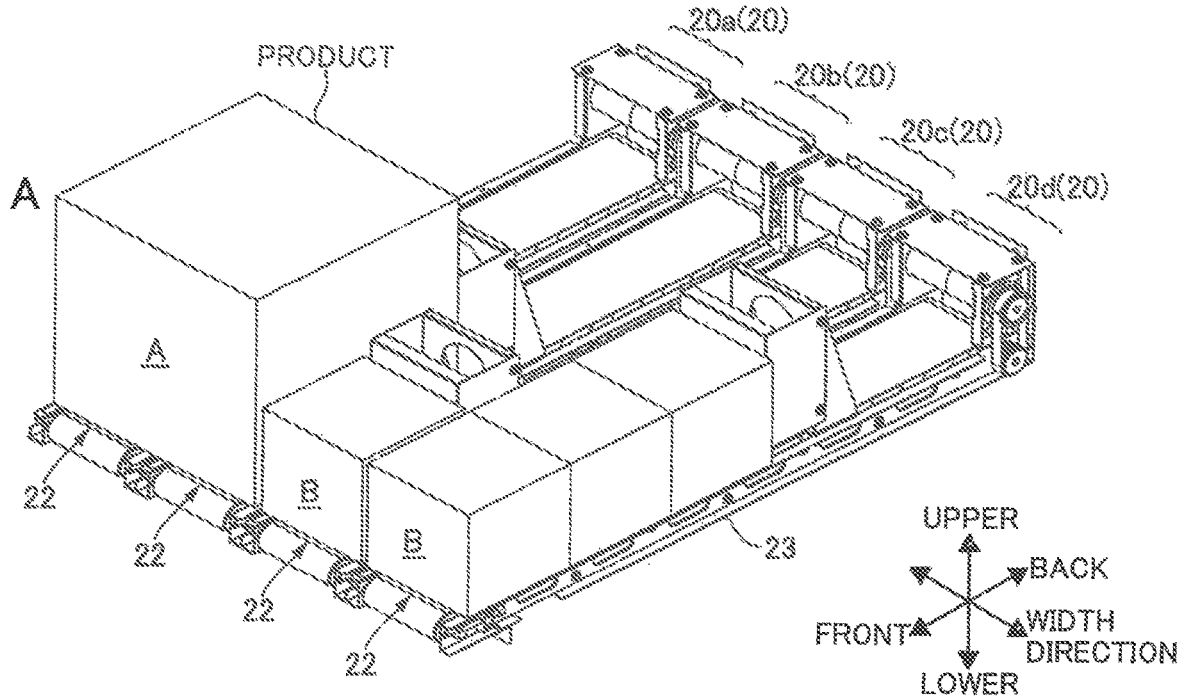
FIGS. 2A and 2B are enlarged views illustrating part of a plurality of columns according to Embodiment 1.
Figure 2:
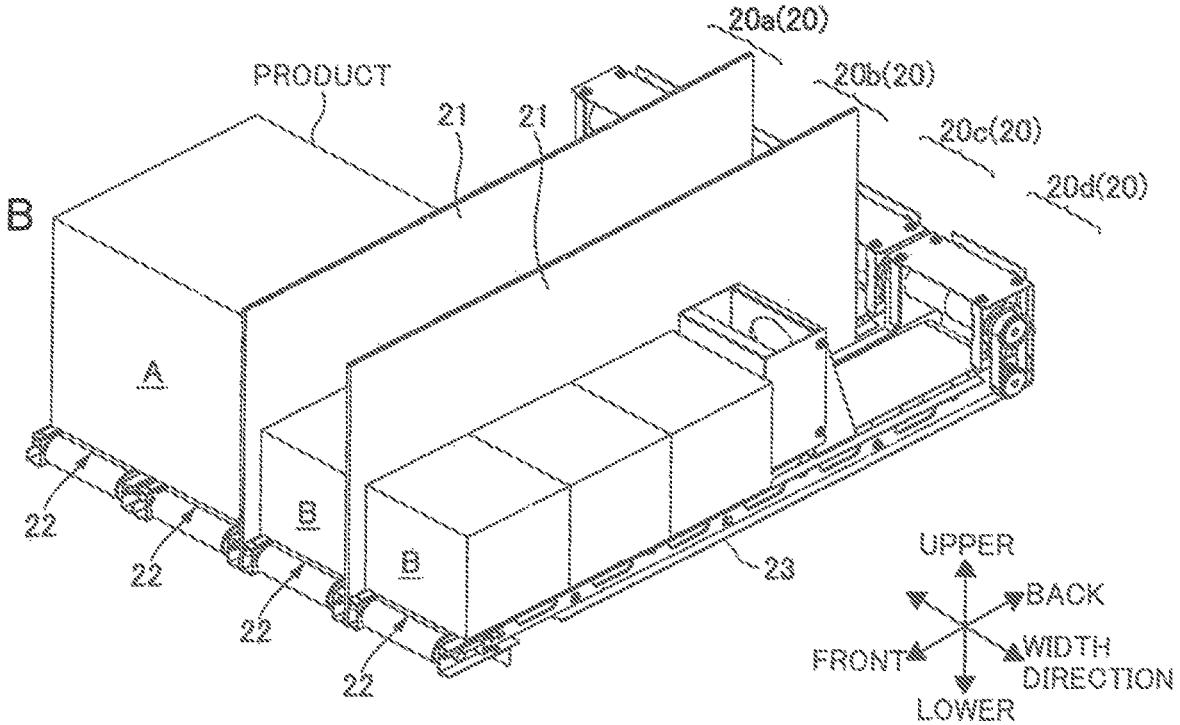

FIGS. 2A and 2B are enlarged views illustrating part of the plurality of columns 20 according to Embodiment 1. FIG. 2A illustrates part of the plurality of columns (20) according to Embodiment 1 without the partition plates 20 provided between the columns 20. FIG. 2B illustrates the partition plates 21 provided between the columns 20 according to Embodiment 1.

As illustrated in FIGS. 2A and 2B, each of the plurality of columns 20 has approximately the same structure, and is disposed such that its width direction and its longitudinal direction correspond to the width direction and the front-to-back direction of the automatic vending machine 1, respectively. Each of the plurality of columns 20 stores products along the longitudinal direction. The products stored in each of the columns 20 are conveyed forward from the back, and carried out of the column 20. Each of the plurality of columns 20 includes a carrying-in part to carry the product to be stored in the column 20 and a carrying-out part to carry the stored product out of the column 20. The carrying-in part and the carrying-out part is formed as one part. With the present embodiment, the carrying-in part and the carrying-out part may be collectively referred to as "carrying-in-and-out part 22."

The carrying-in-and-out part 22 is located at the front end of the belt conveyor 23 described later.

The size of each of the plurality of columns 20 in the width direction is predetermined based on the size of the smallest product in the width direction among different kinds of products sold by the automatic vending machine 1. The size of each of the plurality of columns 20 in the up-and-down direction is predetermined based on the size of the largest product in the up-and-down direction among different kinds of products sold by the automatic vending machine 1. The size of each of the plurality of columns 20 in the front-to-back direction is predetermined based on the size of the largest product in the front-to-back direction among different kinds of products sold by the automatic vending machine 1, and the upper limit of the number of the stored products.

The plurality of columns 20 are configured to allow each of the partition plates 21 to be disposed between the plurality of columns 20 to separate between the plurality of columns 20 according to the kinds of the products. The partition plates 21 can guide to convey the products stored in the plurality of columns 20. The partition plates 21 are removably provided for the plurality of columns 20. The partition plates 21 may be attached and removed by the hands of the operator managing the automatic vending machine 1.

When the size of the product stored in one column 20 is greater than the size of the one column 20 in the width direction, the partition plate 21 between the one column 20 and the next column 20 is removed. By this means, even when the size of the product stored in the one column 20 is greater than the size of the one column 20 in the width direction, it is possible to store the product across the one column and the next column 20. When the product is stored across the one column 20 and the next column 20, the belt conveyor 23 of the one column 20 and the belt conveyor of the next column 20 are controlled such that they are operated in synchronization with one another.

In FIGS. 2A and 2B, four columns 20*a* to 20*d* are illustrated as an example of the plurality of columns 20. FIGS. 2A and 2B illustrate an example where a product A and products B having different sizes are stored in the columns 20*a* to 20*d* as follows. The product A has a size of 200 mm in the width direction, 200 mm in the up-and-down direction, and 200 mm in the front-to-back direction. The product B has a size of 100 mm in the width direction, 100 mm in the up-and-down direction, and 100 mm in the front-to-back direction.

For the example illustrated in FIGS. 2A and 2B, the size of each of the columns 20*a* to 20*d* in the width direction is predetermined based on the size of the product B which is the smallest in the width direction. The size of each of the columns 20*a* to 20*d* in the up-and-down direction is predetermined based on the size of the product A which is the largest in the up-and-down direction.

The size of the product A is greater than the size of each of the columns 20*a* to 20*d* in the width direction, and therefore the product A is stored across the column 20*a* and the column 20*b* next to the column 20*a*. The belt conveyor 23 of the column 20*a* and the belt conveyor 23 of the column 20*b* are controlled such that they are operated in synchronization with one another.

The size of the product B is not greater than the size of each of the columns 20*a* to 20*d* in the width direction, the product B can be stored in one of the column 20*c* and the column 20*d*. In addition, the belt conveyor 23 of the column 20*c* and the belt conveyor 23 of the column 20*d* are controlled such that they are operated individually.

The plurality of columns 20 can store various sizes of products as well as the products A and B. For example, the plurality of columns 20 can store a product in a size of 200 mm in the width direction, 50 mm in the up-and-down direction, and 200 mm in the front-to-back direction. This product is stored across the two adjacent columns 20. Then, the two adjacent belt conveyors 23 of these two columns 20 are controlled such that they are operated in synchronization with one another. Moreover, the plurality of columns 20 can store a product in a size of 400 mm in the width direction, 200 mm in the up-and-down direction, and 200 mm in the front-to-back direction. This product is stored across four adjacent columns 20. Then, the four adjacent belt conveyors 23 of the four columns 20 are controlled such that they are operated in synchronization with each another.

Figure 3:
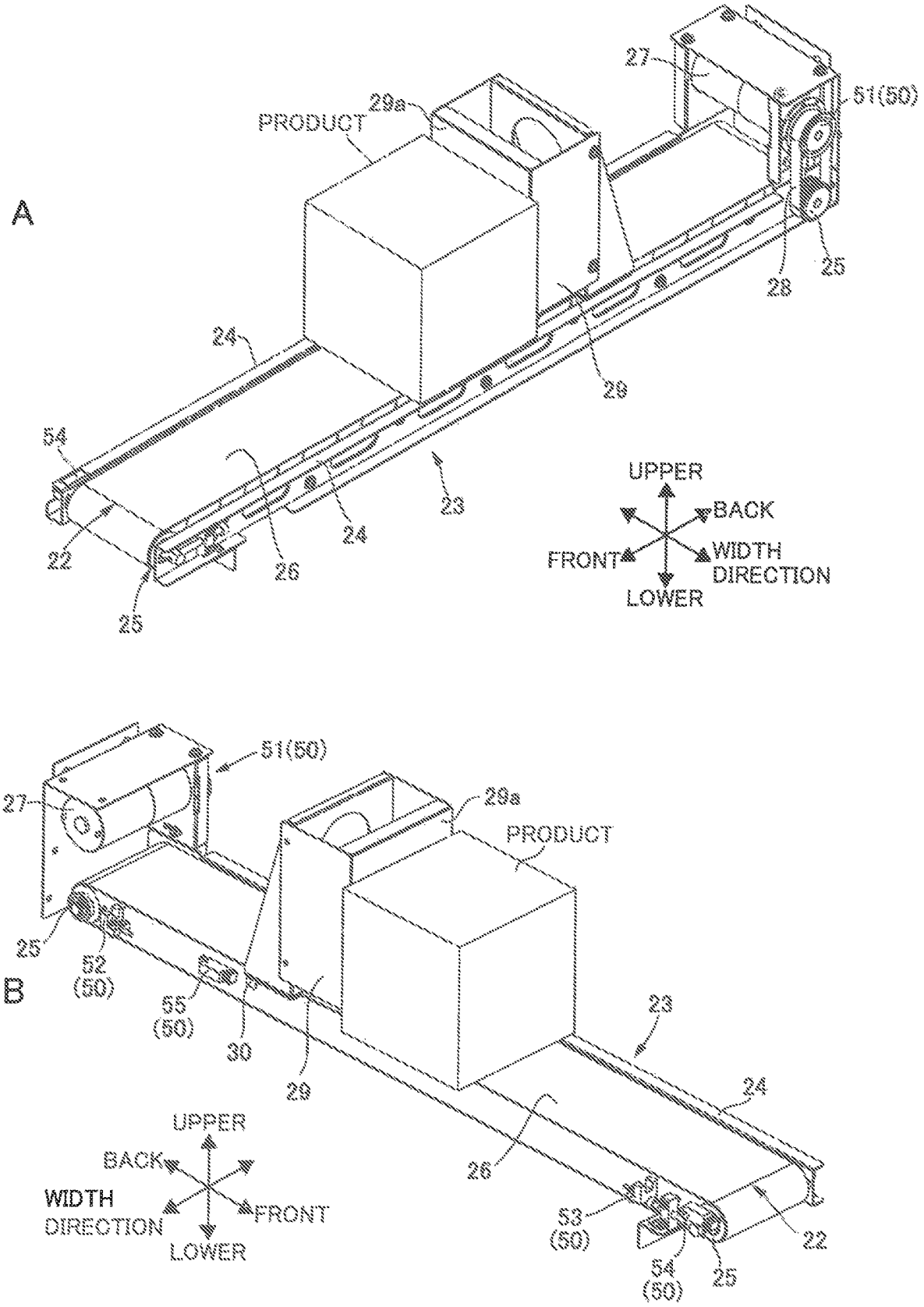
FIGS. 3A and 3B illustrate a belt conveyor constituting a column according to Embodiment 1.

FIGS. 3A and 3B illustrate the belt conveyor 23 constituting the column 20 according to Embodiment 1. FIG. 3A illustrates the configuration of the belt conveyor 23 according to Embodiment 1. FIG. 3B illustrates the belt conveyor 23 viewed from the direction different from that of FIG. 3A. Here, part of a frame 24 described later is not shown in FIG. 3B.

The belt conveyor 23 constitutes part of each of the plurality of columns 20. To be more specific, products are placed on the belt conveyor 23 of each of the plurality of columns 20. The belt conveyor 23 extends along the front-to-back direction of the automatic vending machine 1, that is, the longitudinal direction of the column 20. The belt conveyor 23 conveys the products stored in the column 20 along the longitudinal direction of the column 20.

As illustrated in FIGS. 3A and 3B, the belt conveyor 23 includes the frame 24 as the framework of the belt conveyor 23, and a rotating shaft 25 rotatably provided at both ends of the frame 24. A belt 26 is wrapped around the rotating shaft 25. The belt 26 of the belt conveyor 23 is disposed along the frame 24, and moves in front-to-back direction by the rotation of the rotating shaft 25 to convey the products placed thereon. Also, the belt conveyor 23 includes a motor 27 as a power source to rotate the rotating shaft 25, and a power transmission unit 28 configured to transmit the power of the motor 27 to the rotating shaft 25. Moreover, the belt conveyor 23 includes a pusher 29 configured to move together with the belt 26 and push the products placed on the belt 26 forward, and a sensor dog 30 provided to protrude downward from the lower part of the pusher 29 toward the side surface of the frame 24.

Moreover, the belt conveyor 23 includes a plurality of sensors 50. The plurality of sensors 50 include a rotary encoder 51 provided on the motor 27 and configured to detect the amount of rotational displacement of the motor 27. The rotary encoder 51 can detect the amount of rotational displacement of the motor 27 based on the pulse number of the light passing through and being shielded by a slit formed in the rotating shaft of the motor 27, and the amount of rotational displacement of the motor 27 per pulse. The rotary encoder 51 detects the amount of rotational displacement of the motor 27, and therefore can detect the amount of rotational displacement of the rotating shaft 25 rotating together with the motor 27 to move the belt 26.

Moreover, the plurality of sensors 50 includes a reference position sensor 52 provided on the side surface of the backward part of the frame 24 and configured to detect whether the belt 26 is located at a reference position P1. The position of the belt 26 may be defined by the position of the pusher 29 moving together with the belt 26. An amount of movement D of the belt 26 may be defined by the amount of the movement of the pusher 29 moving together with the belt 26. The reference position P1 is the limit position of the pusher 29 moving backward together with the belt 26. In other words, the reference position P1 is the position of the pusher 29 when the pusher 29 is moved to the back end. The reference position sensor 52 may be a transmissive photosensor including a light emitter and a light receiver spaced from and facing one another. The reference position sensor 52 detects whether the sensor dog 30 provided on the pusher 29 is located between the light emitter and the light receiver, and therefore can detect whether the belt 26 is located at the reference position P1.

Moreover, the plurality of sensors 50 includes an end position sensor 53 provided on the side surface of the forward part of the frame 24 and configured to detect whether the belt 26 is located at an end position P3. The end position P3 is the limit position of the pusher 29 moving forward together with the belt 26. In other words, the end position P3 is the position of the pusher 29 when the pusher 29 is moved to the front end. The end position sensor 53 may be a transmissive photosensor including a light emitter and a light receiver spaced from and facing one another. The end position sensor 53 detects whether the sensor dog 30 provided on the pusher 29 is located between the light emitter and the light receiver, and therefore can detect whether the belt 26 is located at the end position P3.

Furthermore, the plurality of sensors 50 includes a product sensor 54 provided on the frame 24 near the carrying-in-and-out part 22 and configured to detect whether the product is located at the carrying-in-and-out part 22. The product sensor 54 may be a reflective photosensor including a light emitter and a light receiver which are disposed to face upward. The product sensor 54 is disposed to cover the light-emitting surface of the light emitter and the light-receiving surface of the light receiver with the product located at the carrying-in-and-out part 22. The product sensor 54 detects whether the light emitted from the light emitter is reflected by the product located at the carrying-in-and-out part 22 and received by the light receiver, and therefore can detect whether the product is located at the carrying-in-and-out part 22.

Furthermore, the plurality of sensors 50 includes a partition plate sensor 55 configured to detect whether there is the partition plate 21. The partition plate sensor 55 is provided between each of the plurality of columns 20. One partition plate sensor 55 is associated with one partition plate 21 disposed between each of the plurality of columns 20. The partition plate sensor 55 may be provided on the side surface of the frame 24 of at least one of the two adjacent belt conveyors 23.

The partition plate sensor 55 may be a reflective photosensor including a light emitter and a light receiver which are disposed on the side surface of frame 24 to face outward. When there is the partition plate 21, the partition plate sensor 55 is disposed to cover the light-emitting surface of the light emitter and the light-receiving surface of the light receiver with the partition plate 21. The partition plate sensor 55 detects whether the light emitted from the light emitter is reflected by the partition plate 21 and received by the light receiver, and therefore can detect whether there is the partition plate 21.

Figure 4:
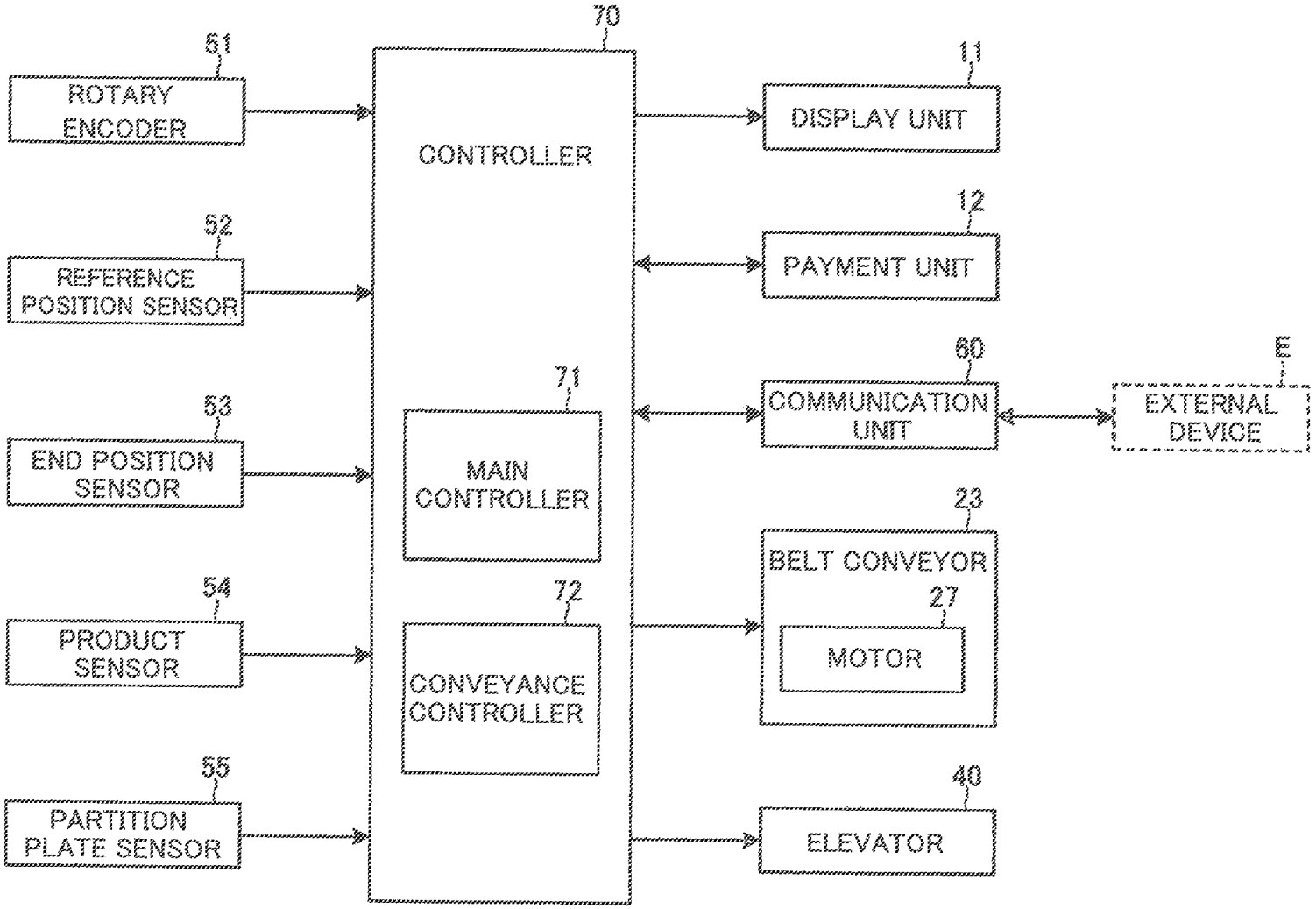
FIG. 4 is a block diagram illustrating the functional configuration of the automatic vending machine according to Embodiment 1.

FIG. 4 is a block diagram illustrating the functional configuration of the automatic vending machine 1 according to Embodiment 1.

A controller 70 is a control unit configured to control the operation of the automatic vending machine 1 and includes a processor and a memory. As illustrated in FIG. 4, the controller 70 includes a main controller 71 configured to generally control the operation of each of the components of the automatic vending machine 1, and a conveyance controller 72 configured to control the operations of the belt conveyor 23 and the elevator 40.

The plurality of sensors 50 including the rotary encoder 51, the reference position sensor 52, the end position sensor 53, and the product sensor 54 are connected to the controller 70 to notify the controller 70 of the detection results from the plurality of sensors 50. In addition, the motor 27 of the belt conveyor 23 and the elevator 40 are connected to the controller 70. The controller 70 controls the operations of the motor 27 of the belt conveyor 23 and the elevator 40, based on the detection results from the plurality of sensors 50.

In particular, the controller 70 acquires the amount of movement D of the belt 26 of the belt conveyor 23, based on the detection results from the plurality of sensors 50. Then, the controller 70 can calculate the number of products stored in each of the plurality of columns 20, based on the acquired amount of movement D of the belt 26. By this means, the controller 70 can manage the inventory status of the products of the automatic vending machine 1.

The inventory status of the products of the automatic vending machine 1 varies by carrying the products out of the plurality of columns 20 because the products are sold by the automatic vending machine 1, or carrying the products in the plurality of columns 20 when the automatic vending machine 1 is replenished with products. With the present embodiment, a process related to the inventory management of the automatic vending machine 1, which is performed when products are carried out of the plurality of columns 20 may be referred to as "product carrying-out process." With the present embodiment, a process related to the inventory management of the automatic vending machine 1, which is performed when products are carried in the plurality of columns 20 may be referred to as "product carrying-in process." With the present embodiment, a process related to the inventory management of the automatic vending machine 1, which is performed to check the inventory of the products in the automatic vending machine 1 may be referred to as "inventory check process." Here, details of the inventory check process will be described later with reference to FIGS. 6 to 8A-8C. Details of the product carrying-out process will be described later with reference to FIGS. 9 and 10A-10C. Details of the product carrying-in process will be described later with reference to FIGS. 11 and 12A-10C.

A communication unit 60 configured to communicate with an external device E located outside the automatic vending machine 1 is connected to the controller 70. The external device E is a management server to manage the automatic vending machine 1, or a mobile unit belonging to the operator of the automatic vending machine 1. The communication unit 60 receives the product information of the products to be stored in the plurality of columns 20, which is transmitted from the external device E, and notifies the controller 70 of the product information. The product information transmitted from the external device E includes information on the image, the name, the kind, the price, and the description of the product, and is accompanied by supplementary information which allows the layout of the products for the plurality of columns 20 to be specified. The supplementary information may be metadata of the product information.

The controller 70 specifies the layout of the products for the plurality of columns 20 based on the supplementary information. Then, the controller 70 associates the specified layout with the plurality of columns 20 such that the products can be stored in the plurality of columns 20 according to the specified layout to convey the products by the belt conveyors 23. With the present embodiment, a process of setting the layout of the products for the plurality of columns 20 may be referred to as "layout setting process." Details of the layout setting process will be described later with reference to FIG. 5.

The layout of the products for the plurality of columns 20 is predetermined by the management server that manages the automatic vending machine 1. In this case, the supplementary information includes layout information indicating the correspondence relationship between the plurality of columns 20 and the products stored in these columns 20. The communication unit 60 receives the product information and the supplementary information transmitted from the management server, so that the controller 70 can acquire the layout information.

Here, the layout of the products for the plurality of columns 20 may be determined by the operator managing the automatic vending machine 1. The operator receives the product information and the supplementary information transmitted from the management server by the mobile unit, and displays the information on the mobile unit. Then, the operator determines the correspondence relationship between the plurality of columns 20 and the products stored in these columns 20, based on the product information and the layout information contained in the supplementary information, updates the layout information, and transmits the updated layout information to the automatic vending machine 1. The communication unit 60 receives the product information and the supplementary information transmitted from the management server via the mobile unit of the operator, so that the controller 70 can acquire the layout information.

Figure 5:
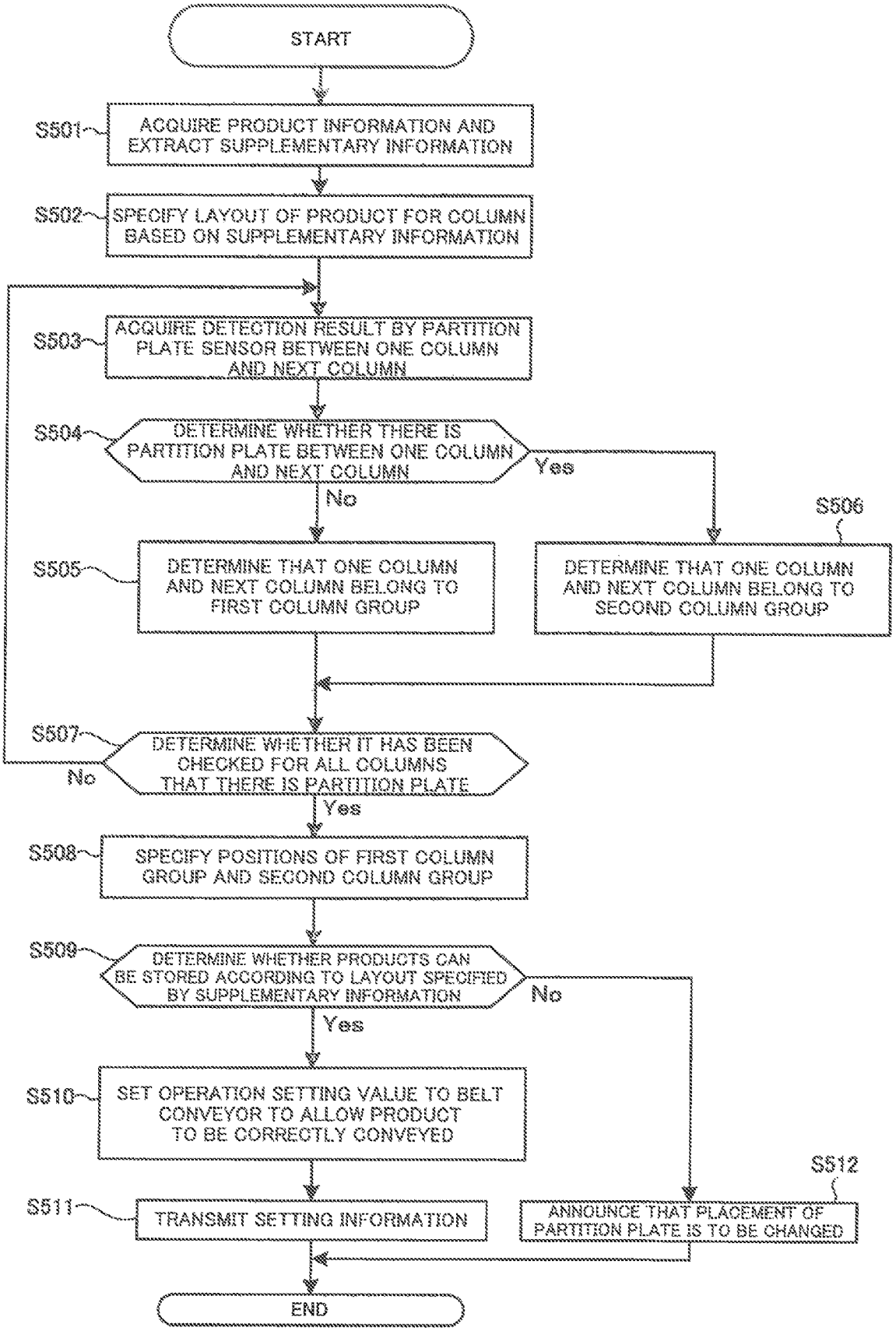
FIG. 5 is a flowchart illustrating a layout setting process according to Embodiment 1.

Embodiment 1: Process Related to Inventory Management of Automatic Vending Machine FIG. 5 is a flowchart illustrating a layout setting process according to Embodiment 1.

In step 501, the controller 70 acquires the product information transmitted from the external device E and received by the communication unit 60, and extracts the supplementary information from the acquired product information.

In step 502, the controller 70 specifies the layout of the products for the plurality of columns 20, based on the supplementary information. To be more specific, the controller 70 refers to the layout information contained in the supplementary information, and specifies the layout of the products for the plurality of columns 20.

In step 503, the controller 70 acquires the detection result from the partition plate sensor 55 provided between one column 20 and the next column 20 of the plurality of columns 20.

In step 504, the controller 70 determines whether there is the partition plate 21 between the one column 20 and the next column 20, based on the detection result acquired from the partition plate sensor 55. When determining that there is the partition plate 21 between the one column 20 and the next column 20, the controller 70 moves the step to step 506. On the other hand, when determining that there is no partition plate 21 between the one column 20 and the next column 20, the controller 70 moves the step to step 505.

In the step 505, the controller 70 determines that the one column 20 and the next column 30 belong to a first column group that allows the product to be stored across the one column 20 and the next column 20. As described above, when the size of a product stored in the one column 20 in the width direction is greater than the size of the one column 20 in the width direction, this product is stored across the one column 20 and the next column 20. Therefore, it is required that there is no partition plate 21 between the one column 20 and the next column 20. Accordingly, when there is no partition plate 21 between the one column 20 and the next column 20, the controller 70 determines that the one column 20 and the next column 20 belong to the first column group that allows the product to be stored across the first column 20 and the next column 20.

In this case, it is also required that the belt conveyor 23 of the one column 20 and the belt conveyor 23 of the next column are set to be operated in synchronization with one another. If these belt conveyors 23 are not operated in synchronization, the product stored across the one column and the next column cannot be properly conveyed, and therefore a malfunction of the automatic vending machine 1 may occur. When there is no partition plate 21 between the one column 20 and the next column 20, the controller 70 determines that the belt conveyor 23 of the one column 20 and the belt conveyor 23 of the next column 20 belong to a first conveyor group that is operated in synchronization.

In the step 506, the controller 70 determines that the one column 20 and the next column 20 belong to a second column group that does not allow the products to be stored across the one column 20 and the next column 20. That is, when there is the partition plate 21 between the one column 20 and the next column 20, the controller 70 determines that the one column 20 and the next column 20 belong to the second column group that does not allow the products to be stored across the one column 20 and the next column 20. In addition, when there is the partition plate 21 between the one column 20 and the next column 20, the controller 70 determines that the belt conveyor 23 of the one column 20 and the belt conveyor 23 of the next column 20 belong to the second conveyor group that are not operated in synchronization.

In step 507, the controller 70 determines whether it has been checked for all the plurality of columns 20 of the automatic vending machine 1 whether there is the partition plate 21 between two adjacent columns 20. When determining that it has not been checked for all the plurality of columns 20 of the automatic vending machine 1 whether there is the partition plate 21 between two adjacent columns 20, the controller 70 moves the step to the step 503. On the other hand, when determining that it has been checked for all the plurality of columns 20 whether there is the partition plate 21 between two adjacent columns 20, the controller 70 moves the step to step 508.

In the step 508, the controller 70 specifies the position of the first column group and the position of the second column group of the plurality of columns 20.

In step 509, the controller 70 determines whether the products can be stored according to the layout specified by the supplementary information, based on the position of the first column group and the position of the second column group specified in the step 508. When determining that the products cannot be stored according to the layout specified by the supplementary information, the controller moves the step to step 512. On the other hand, when determining that the products can be stored according to the layout specified by the supplementary information, the controller moves the step to step 510.

In the step 510, the controller 70 sets an operation setting value to each of the plurality of belt conveyors 23 in order to allow the products stored according to the layout specified by the supplementary information to be correctly conveyed. For example, the controller 70 sets the operation setting value to the belt conveyors 23 of the first conveyor group such that the belt conveyors 23 adjacent to one other are operated in synchronization. Note that when there are a plurality of first conveyor groups, the controller 70 sets the operation setting values to the belt conveyors 23 such that the belt conveyors 23 of one first conveyor group are operated in synchronization, but not the belt conveyors 23 of all the first conveyor groups are operated in synchronization. In addition, the controller 70 sets the operation setting value to the belt conveyors 23 of the second conveyor group to individually operate the belt conveyors 23.

In the step 511, the controller 70 transmits the setting information indicating the operation setting value for each of the plurality of belt conveyors 23 from the communication unit 60 to the external device E. Then, the controller 70 ends the process.

In the step 512, the controller 70 announces that the placement of the partition plates 21 is to be changed. To be more specific, the controller 70 announces that the placement of the partition plates 21 needs to be changed by using a display different from the display unit 11 provided in the housing 2, or by transmission from the communication unit 60 to the mobile unit of the operator. Also, the controller 70 may notify the management server that the placement of the partition plates 21 needs to be changed by transmission. Then, the controller 70 ends the process.

Figure 6:
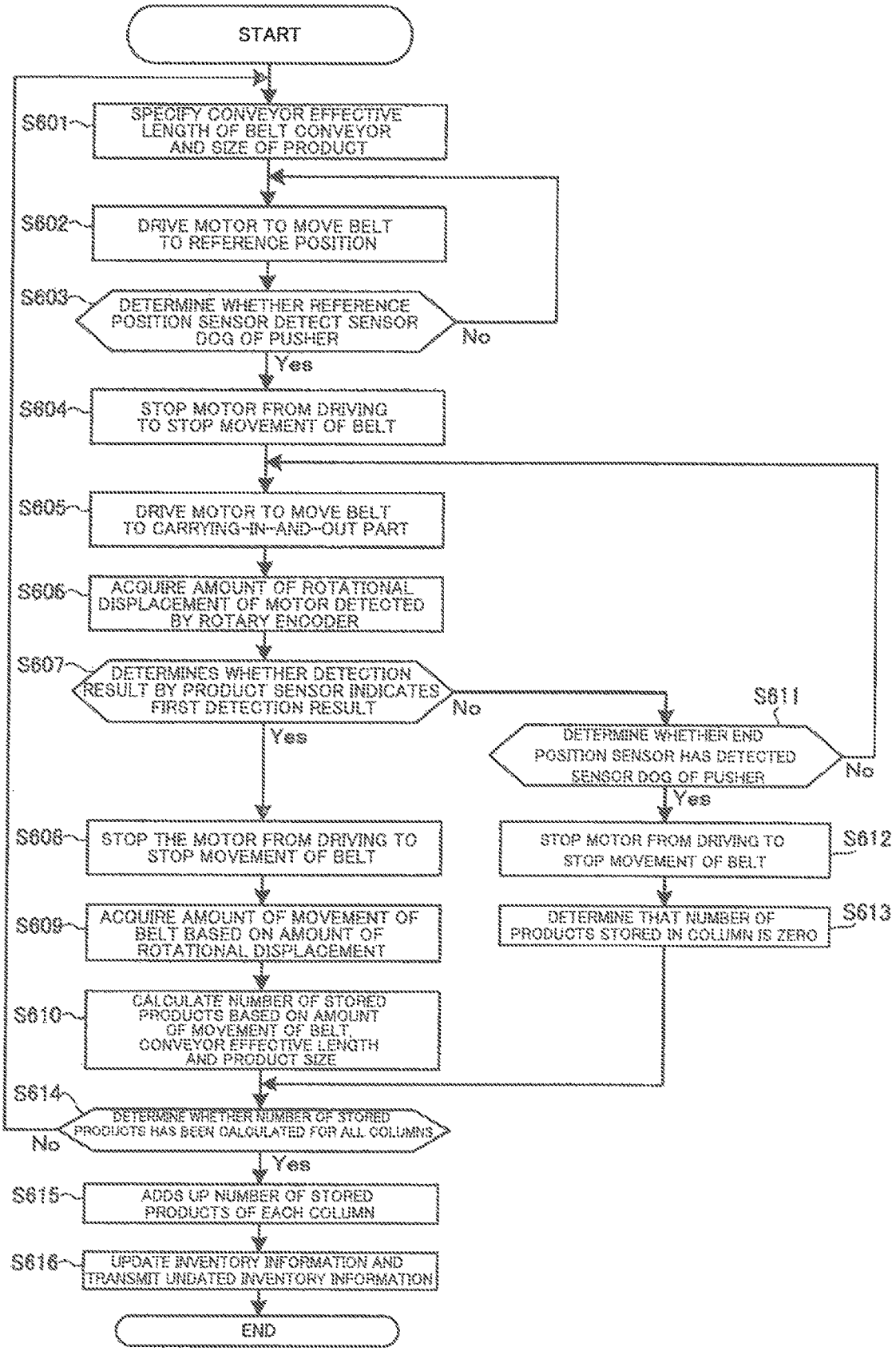
FIG. 6 is a flowchart illustrating an inventory check process according to Embodiment 1.
Figure 7:
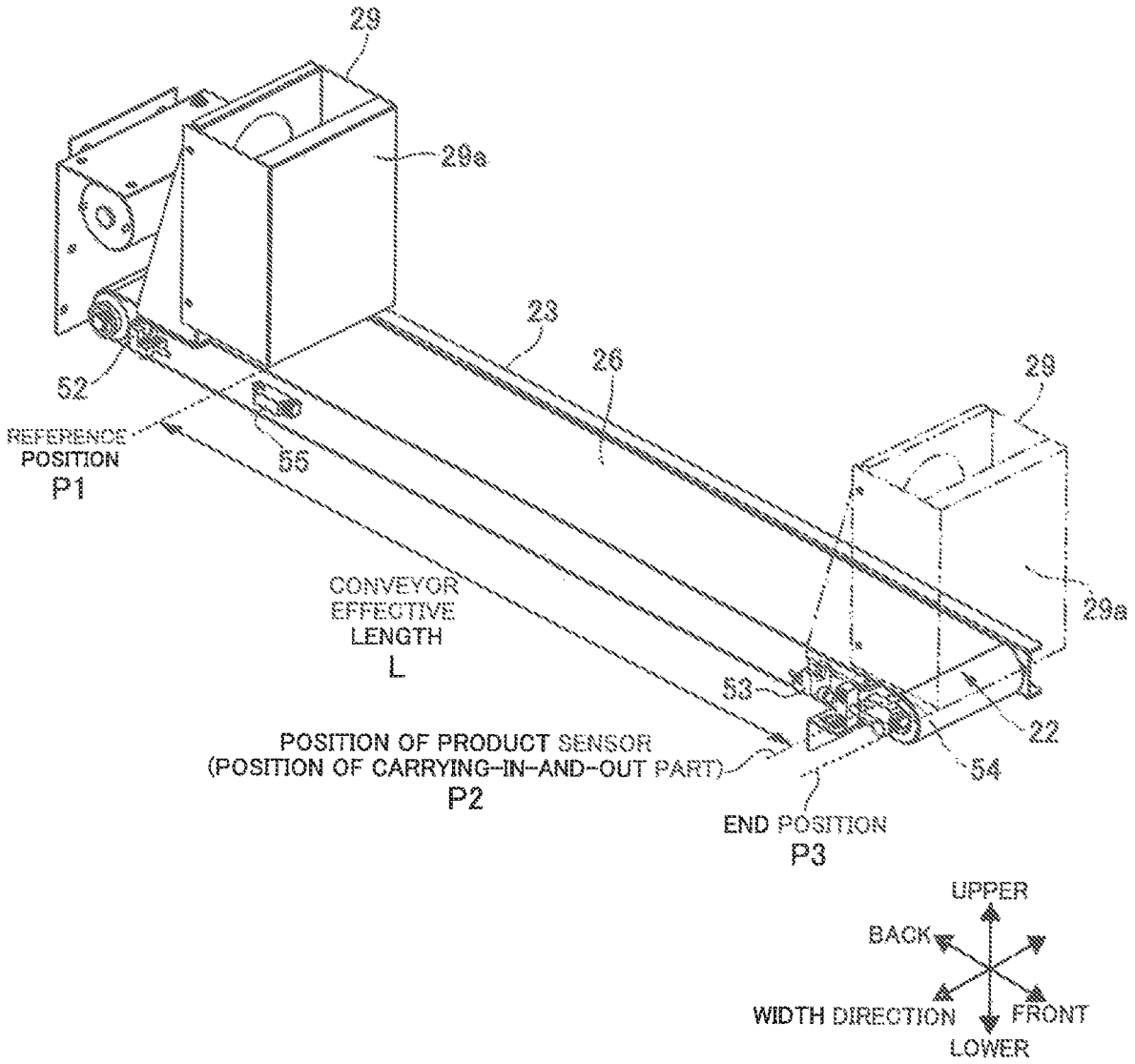
FIG. 7 illustrates a conveyor effective length of the belt conveyor according to Embodiment 1.
Figure 8:
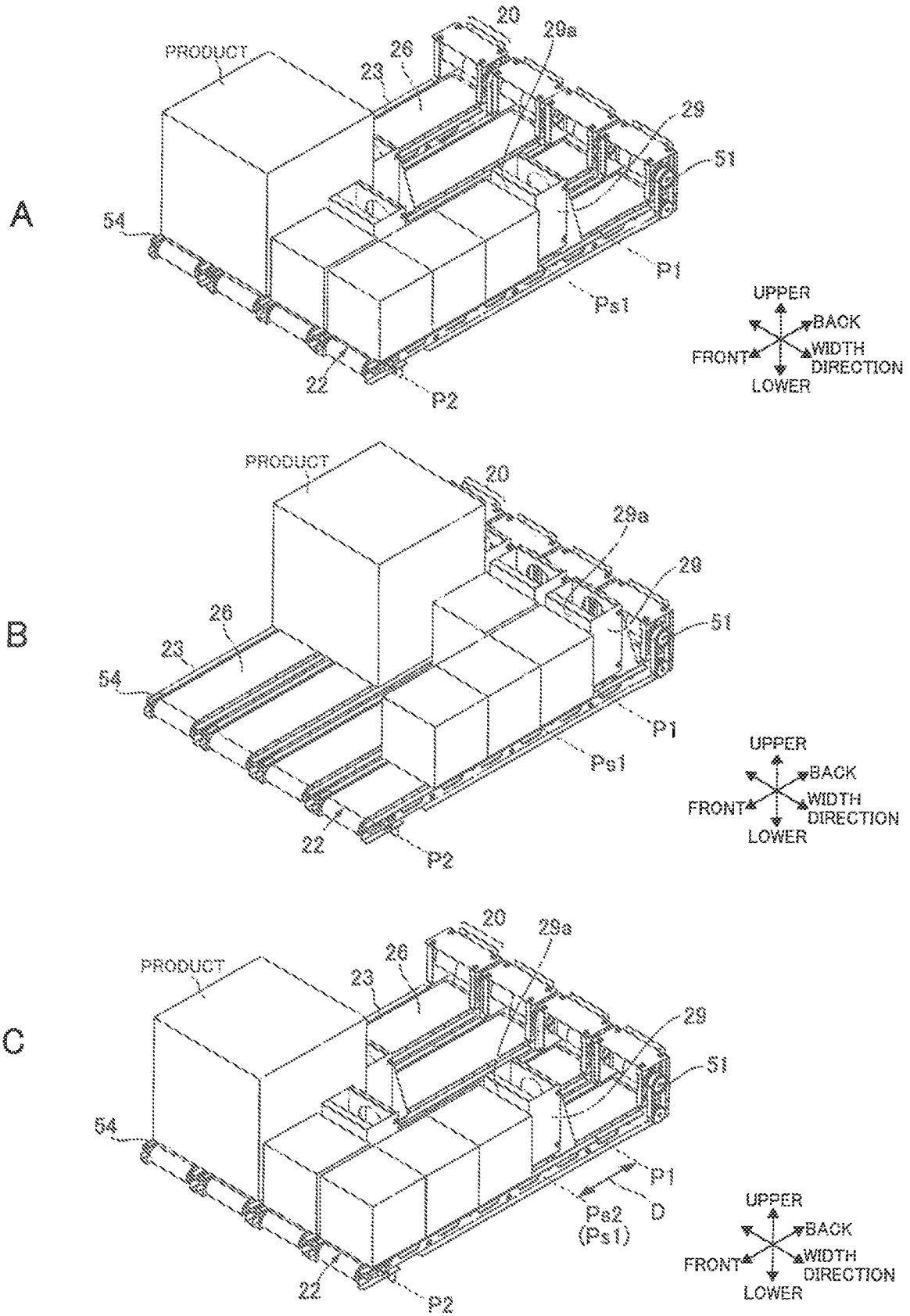
FIGS. 8A-8C illustrate the inventory check process according to Embodiment 1.

FIG. 6 is a flowchart illustrating an inventory check process according to Embodiment 1. FIG. 7 illustrates a conveyor effective length L of the belt conveyor 23 according to Embodiment 1. FIGS. 8A-8C illustrate the inventory check process according to Embodiment 1. FIG. 8A illustrates the belt conveyors 23 before the inventory check process according to Embodiment 1. FIG. 8B illustrates the belt conveyors 23 after the belt 26 is moved to the reference position P1 in the inventory check process according to Embodiment 1. FIG. 8C illustrates the belt conveyors 23 after the belt 26 is moved to locate the front product at the carrying-in-and-out part 22 in the inventory check process according to Embodiment 1. Here, the partition plate 21 is not shown in FIGS. 8A to 8C.

Before the inventory check process, it is preferred that the belts 26 of the belt conveyors 23 are placed in a state where the front one of the products stored in each of the plurality of columns 20 is located at the carrying-in-and-out part 22, as illustrated in FIG. 8A. To be more specific, it is preferred that each of the belts 26 is placed in a state where the front end of the front product stored in the column 20 is located at a position P2 of the product sensor 54. The product located at the carrying-in-and-out part 22 will be carried out of the column 20, for example, when it is sold, and therefore stands by the carrying out of the column 20.

With the present embodiment, the position of the belt 26 when the front one of the products stored in the column 20 is located at the carrying-out part 22 may be referred to as "standby position Ps." The standby position Ps is changed in the front-to-back direction depending on the size of each of the products stored in the column 20 in the front-to-back direction and the number of the products stored in the column 20. It is preferred that the belt 26 is located at the standby position Ps before the product carrying-out process, and before the product carrying-in process as well as before the inventory check process. With the present embodiment, the standby position Ps of the belt 26 before the inventory check process, the product carrying-out process, or the product carrying-in process may be referred to as "standby position Ps1." With the present embodiment, the standby position Ps of the belt 26 after the inventory check process, the product carrying-out process, or the product carrying-in process may be referred to as "standby position Ps2."

In step 601, the controller 70 specifies the conveyor effective length L of the belt conveyor 23 of one column 20, and the size of the products stored in the one column 20. The conveyor effective length L is the distance between a front surface 29*a* of the pusher 29 and the product sensor 54 when the belt 26 is located at the reference position P1, as illustrated in FIG. 7. The specified size of the product is the size of the product in the front-to-back direction.

In step 602, the controller 70 drives the motor 27 to move the belt 26 to the reference position P1. That is, the controller 70 drives the motor 27 to move the belt 26 backward.

In step 603, the controller 70 determines whether the reference position sensor 52 has detected the sensor dog 30 of the pusher 29. When determining that the reference position sensor 52 has not detected the sensor dog 30, the controller 70 moves the step to the step 602. On the other hand, when determining that the reference position sensor 52 has detected the sensor dog 30, the controller 70 moves the step to step 604.

In the step 604, the controller 70 stops the motor 6 from driving to stop the movement of the belt 26. That is, when the belt 26 is located at the reference position P1 as illustrated in FIG. 8B, the controller 70 stops the belt 26 from moving.

In step 605, the controller 70 drives the motor 27 to move the belt 26 to the carrying-in-and-out part 22. That is, the controller 70 drives the motor 27 to move the belt 26 forward.

In step 606, the controller 70 acquires the amount of rotational displacement of the motor 27 detected by the rotary encoder 51.

In step 607, the controller 70 determines whether the detection result by the product sensor 54 indicates a first detection result. The first detection result by the product sensor 54 indicates that the product is located at the carrying-in-and-out part 22. A second detection result by the product sensor 54 indicates that there is no product at the carrying-in-and-out part 22.

In a case where the detection result by the product sensor 54 indicates the first detection result in the step 607, the front product stored in the column 20 has been moved to the carrying-in-and-out part 22 and the belt 26 has been moved to the standby position Ps2. In this case, the controller 70 moves the step to step 608 to stop the movement of the belt 26. On the other hand, a case where the detection result by the product sensor 54 does not indicate the first detection result means a situation where there is no product in the column 20, or a situation where the belt 26 is located behind the standby position Ps2 although there is a product in the column 20. The controller 70 moves the step to step 611 to determine which of the situations true is.

In the step 608, the controller 70 stops the motor 27 from driving to stop the movement of the belt 26. That is, the controller 70 stops the belt 26 from moving when the belt 26 is located at the standby position Ps2 as illustrated in FIG. 8C. Here, for the inventory check process, the standby position Ps2 is approximately the same as the standby position Ps1 before the inventory check process.

In step 609, the controller 70 acquires the amount of movement D of the belt 26, based on the amount of rotational displacement of the motor 27. The amount of movement D of the belt 26 correlates with the amount of rotational displacement of the rotating shaft 25, and the amount of rotational displacement of the rotating shaft 25 correlates with the amount of rotational displacement of the motor 27. These correlations are recognized by the controller 70 in advance. The controller 70 can acquire the amount of movement D of the belt 26 by using the amount of rotational displacement of the motor 27 detected by the rotary encoder 51, and the above-described correlations.

For example, it is assumed that the amount of rotational displacement of the rotating shaft 25 has the correspondence relationship with that of the motor 27 one-on-one, and the amount of movement of the belt 26 per unit amount of the rotational displacement of the rotating shaft 25 is known. In this case, the controller 70 can acquire the amount of movement D of the belt 26 by multiplying the amount of movement of the belt 26 per unit amount of the rotational displacement of the rotating shaft 25 by the amount of rotational displacement of the motor 27 detected by the rotary encoder 51. The amount of movement D of the belt 26 is acquired when the belt 26 is moved between the standby position Ps2 and the reference position P1 in the step 609.

In step 610, the controller 70 calculates the number of the products stored in the column 20 (hereinafter "the number of the stored products"), based on the amount of movement D of the belt 26 acquired in the step 609, the conveyor effective length L specified in the step 601, and the size of the products specified in the step 601. Then, the controller 70 moves the step to step 614.

The controller 70 can calculate the number of the stored products by using the following equation (1).

$$\text{The number of the stored products} = \{(\text{conveyor effective length } L) - (\text{the amount of movement } D \text{ of the belt})\}/(\text{the size of the product in the front-to-back direction}) \quad \text{Equation (1)}$$

In the step 611, the controller 70 determines whether the end position sensor 53 has detected the sensor dog 30 of the pusher 29. When the end position sensor 53 has not detected the sensor dog 30 in the step 611, the belt 26 is located behind the standby position Ps2 although there is a product in the column 20. In this case, the controller 70 moves the step to the step 605 to move the belt 26 to the standby position Ps2. On the other hand, when the end position sensor 53 has detected the sensor dog 30 in the step 611, there is no product stored in the column 20. In this case, the controller 70 moves the step to step 612 to stop the movement of the belt 26.

In the step 612, the controller 70 stops the motor 27 from driving to stop the movement of the belt 26. That is, the controller 70 stops the movement of the belt 26 when the belt 26 is located at the end position P3.

In step 613, the controller 70 determines that the number of products stored in the column 20 is zero. Then, the controller 70 moves the step to step 614.

In the step 614, the controller 70 determines whether the number of the stored products has been calculated for all the plurality of columns 20 of the automatic vending machine 1. When determining that the number of the stored products has not been calculated for all the plurality of columns 20, the controller 70 moves the step to the step 601. On the other hand, when determining that the number of the stored products has been calculated for all the plurality of columns 20, the controller 70 moves the step to step 615.

In the step 615, the controller 70 adds up the number of the stored products of each of the plurality of columns 20.

In the step 616, the controller 70 updates the inventory information of the automatic vending machine 1 indicating the correlation among the plurality of columns 20, the products stored in the plurality of columns 20, and the number of the stored products. Then, the controller 70 transmits the updated inventory information from the communication unit 60 to the external device E. Then, the controller 70 ends the process.

Figure 9:
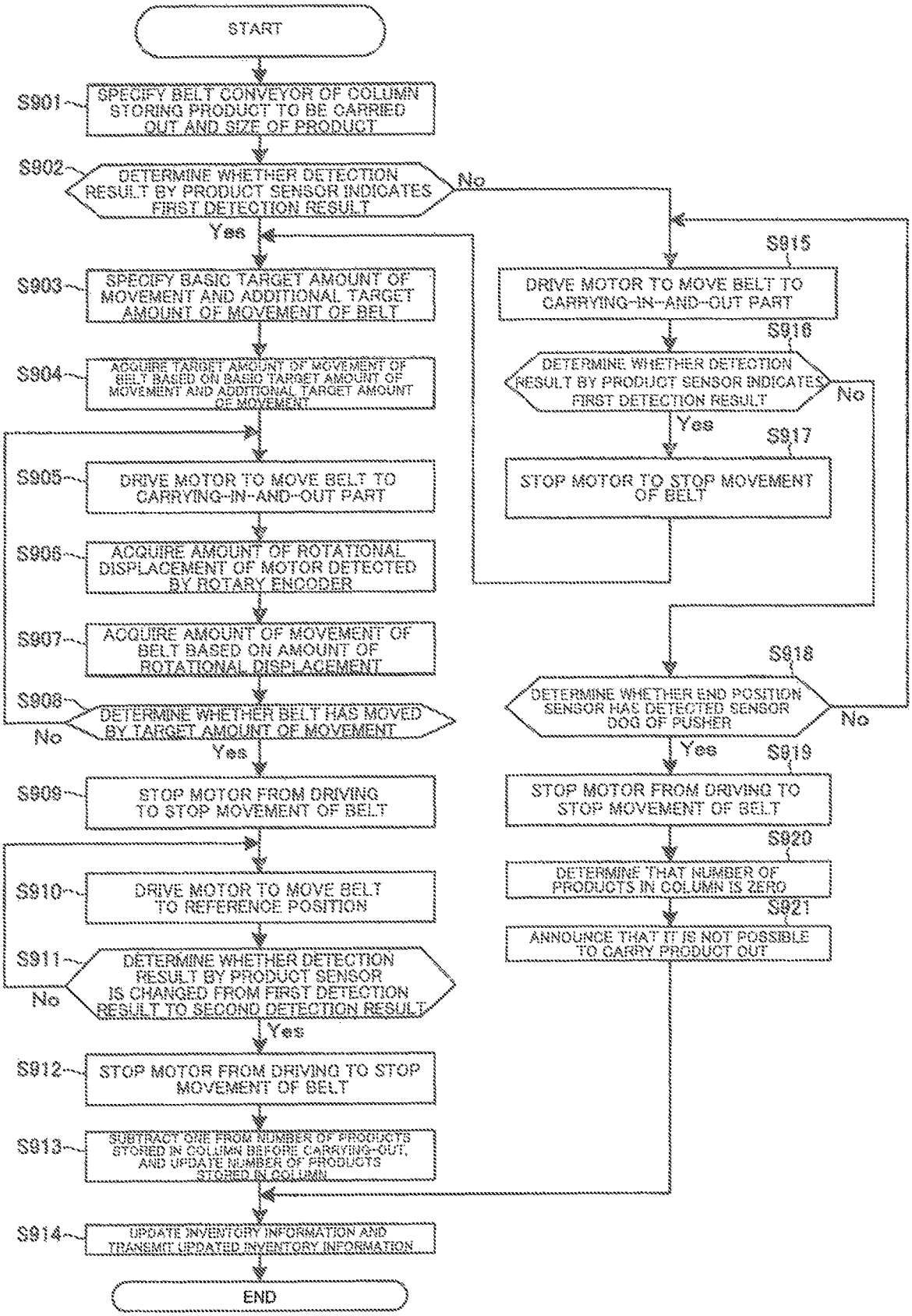
FIG. 9 is a flowchart illustrating a product carrying-out process according to Embodiment 1.
Figure 10:
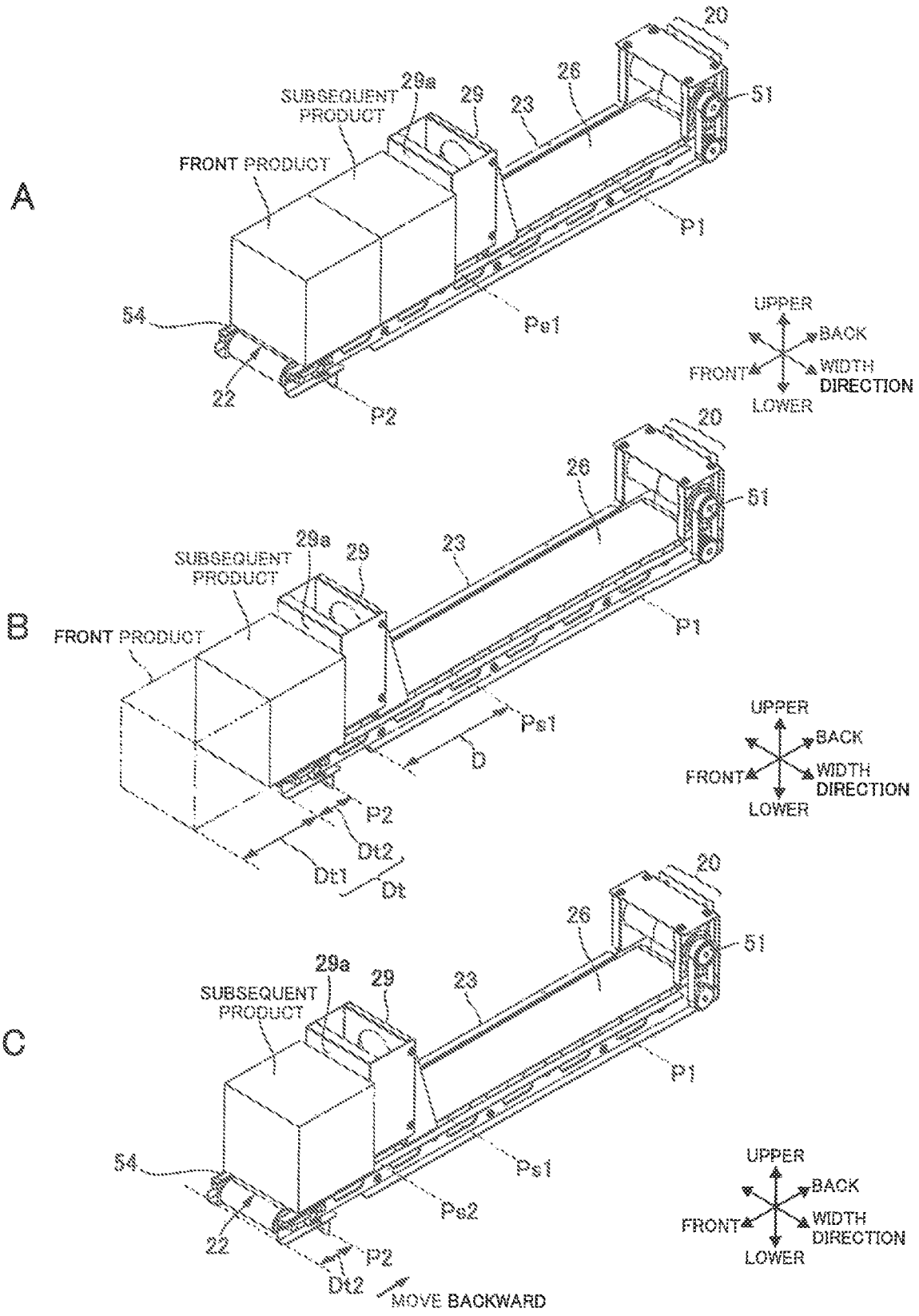
FIGS. 10A-10C illustrate the product carrying-out process according to Embodiment 1.

FIG. 9 is a flowchart illustrating a product carrying-out process according to Embodiment 1. FIGS. 10A-10C illustrate the product carrying-out process according to Embodiment 1. FIG. 10A illustrates the belt conveyor 23 before the product carrying-out process according to Embodiment 1. FIG. 10B illustrates the belt conveyor 23 after the front product is carried out of the column 20 in the product carrying-out process according to Embodiment 1. FIG. 10C illustrates the belt conveyor 23 after the subsequent product is moved backward in the product carrying-out process according to Embodiment 1.

In step 901, the controller 70 specifies the belt conveyor 23 of the column 20 storing the product to be carried out of the column 20, for example, for sale, and the size of the product to be carried out in the front-to-back direction. When the product is carried out of the column 20 for sale, the display unit 11 and the payment unit 12 notify the controller 70 of the column 20 storing the product to be carried out. The controller 70 specifies the belt conveyor 23 of the column 20 storing the product to be carried out and the size of this product in the front-to-back direction.

In step 902, the controller 70 determines whether the detection result by the product sensor 54 indicates the first detection result. That is, the controller 70 determines whether the belt 26 is located at the standby position Ps1. As described above, the belt conveyor 23 is controlled by the controller 70 in advance to locate the belt 26 at the standby position Ps1 as illustrated in FIG. 10A. However, there is a possibility that the belt 26 is not located at the standby position Ps1 because any accident occurs in the automatic vending machine 1. Therefore, the controller 70 determines whether the belt 26 is located at the standby position Ps1. When determining that the detection result by the product sensor 54 does not indicate the first detection result, the controller 70 moves the step to step 915. On the other hand, when determining that the detection result by the product sensor 54 indicates the first detection result, the controller 70 moves the step to step 903.

In the step 903, the controller 70 specifies a basic target amount of movement Dt1 and an additional target amount of movement Dt2 of the belt 26. The basic target amount of movement Dt1 of the belt 26 is an amount of movement of the belt 26 for which the front product to be carried out has passed through the carrying-in-and-out part 22. To be more specific, the basic target amount of movement Dt1 is an amount of movement of the belt 26 for which the front end of the front product to be carried out is moved from the position P2 of the product sensor 54 to a position beyond the position P2 as illustrated in FIG. 10B. The basic target amount of movement Dt1 corresponds to the size of one product in the front-to-back direction.

The additional target amount of movement Dt2 of the belt 26 is an amount of movement of the belt 26 required to set the product in the elevator 40. In other words, the additional target amount of movement Dt2 is an amount of movement of the belt 26 required to push the front product to be carried out into the elevator 40 by the pusher 29. To be more specific, the additional target amount of movement Dt2 is an amount of movement of the belt 26 for which the front end of the front product to be carried out which has passed through the position P2 of the product sensor 54 as illustrated in FIG. 10B is correctly put on the elevator 40. The additional target amount of movement Dt2 is predetermined based on the size of the product and the size of the elevator 40 in the front-to-back direction and the distance between the elevator 40 and the carrying-in-and-out part 22.

In step 904, the controller 70 acquires the target amount of movement Dt of the belt 26, based on the basic target amount of movement Dt1 and the additional target amount of movement Dt2 of the belt 26. To be more specific, the controller 70 acquires the target amount of movement Dt of the belt 26 by adding the basic target amount of movement Dt1 and the additional target amount of movement Dt2 of the belt 26.

In step 905, the controller 70 drives the motor 27 to move the belt 26 to the carrying-in-and-out part 22.

In step 906, the controller 70 acquires the amount of rotational displacement of the motor 27 detected by the rotary encoder 51.

In step 907, the controller 70 acquires the amount of movement D of the belt 26 based on the amount of rotational displacement of the motor 27.

In step 908, the controller 70 determines whether the belt 26 has moved by the target amount of movement Dt. To be more specific, the controller 70 determines whether the amount of movement of the belt 26 acquired in the step 907 meets the target amount of movement Dt of the belt 26 acquired in the step 904. When determining that the belt 26 has not moved by the target amount of movement Dt, the controller 70 moves the step to the step 905. On the other hand, when determining that the belt 26 has moved by the target amount of movement Dt, the controller 70 moves the step to step 909.

In the step 909, the controller 70 stops the motor 27 from driving to stop the movement of the belt 26. That is, the controller 70 stops the movement of the belt 26 when the belt has moved by the target amount of movement Dt as illustrated in FIG. 10B. The front product is carried out of the column 20 from the carrying-in-and-out part 22, and set in the elevator 40.

In step 910, the controller 70 drives the motor 27 to move the belt 26 to the reference position P1. That is, the controller 70 moves the belt 26 in the direction opposite to the conveyance direction of the front product to be carried out to the carrying-in-and-out part 22 to move the subsequent product backward.

In step 911, the controller 70 determines whether the detection result by the product sensor 54 is changed from the first detection result to the second detection result. While the belt 26 has moved by the target amount of movement Dt in the step 909, the subsequent product following the front product to be carried out protrudes forward from the carrying-in-and-out part 22 by the additional target amount of movement Dt2 of the belt 26 specified in the step 903. Then, the controller 70 moves the subsequent product backward to correct the position of the subsequent product not to protrude from the carrying-in-and-out part 22. To be more specific, the controller 70 moves the front end of the subsequent product backward to the position P2 of the product sensor 54.

When the detection result by the product sensor 54 is not changed from the first detection result to the second detection result in the step 911, the front end of the subsequent product has not moved backward to the position P2 of the product sensor 54. In this case, the controller 70 moves the step to the step 910 to move the front end of the subsequent product backward to the position P2 of the product sensor 54. On the other hand, when the detection result by the product sensor 54 is changed from the first detection result to the second detection result, the front end of the subsequent product has moved backward to the position P2 of the product sensor 54. In this case, the controller 70 moves the step to step 912 to stop the movement of the belt 26.

In the step 912, the controller 70 stops the motor 27 from driving to stop the movement of the belt 26. That is, the controller 70 stops the movement of the belt 26 when the front end of the subsequent product has moved backward to the position P2 of the product sensor 54 as illustrated in FIG. 10C. By this means, the position of the subsequent product protruding forward from the carrying-in-and-out part 22 is corrected and properly located at the carrying-in-and-out part 22, and therefore the belt 26 can be located at the standby position Ps2.

In step 913, the controller 70 subtracts one, which is the number of the product carried out, from the number of the products stored in the column 20 before the carrying-out, and updates the number of the products stored in the column 20.

In step 914, the controller 70 updates the inventory information of the automatic vending machine 1. Then, the controller 70 transmits the updated inventory information from the communication unit 60 to the external device E. Then, the controller 70 ends the process.

In step 915, the controller 70 drives the motor 27 to move the belt 26 to the carrying-in-and-out part 22. When the detection result by the product sensor 54 does not indicate the first detection result in the step 902, it is not clear whether there is a product in the column 20. The controller 70 moves the belt 26 forward as the step 915 to determine whether there is a product in the column 20.

In step 916, the controller 70 determines whether the detection result by the product sensor 54 indicates the first detection result. When the detection result by the product sensor 54 indicates the first detection result in the step 916, there is a product in the column 20, the front product to be carried out has moved to the carrying-in-and-out part 22, and the belt 26 has moved to the standby position Ps1. In this case, the controller 70 moves the step to step 917 to stop the movement of the belt 26. On the other hand, a case where the detection result by the product sensor 54 does not indicate the first detection result means a situation where there is no product in the column 20, or a situation where the belt 26 is located behind the standby position Ps1 although there is a product in the column 20. The controller 70 moves the step to step 918 to determine which of the situations true is.

In step 917, the controller 70 stops the motor 27 to stop the movement of the belt 26. That is, when the belt 26 is located at the standby position Ps1, the controller 70 stops the movement of the belt 26.

In the step 918, the controller 70 determines whether the end position sensor 53 has detected the sensor dog 30 of the pusher 29. When the end position sensor 53 has not detected the sensor dog 30 in the step 918, the belt 26 is located behind the standby position Ps1 although there is a product in the column 20. In this case, the controller 70 moves the step to the step 915 to move the belt 26 to the standby position Ps1. On the other hand, when the end position sensor 53 has detected the sensor dog 30 in the step 918, there is no product in the column 20. In this case, the controller 70 moves the step to step 919 to stop the movement of the belt 26.

In the step 919, the controller 70 stops the motor 27 from driving to stop the movement of the belt 26. That is, controller 70 stops the movement of the belt 26 when the belt 26 is located at the end position P3.

In step 920, the controller 70 determines that the number of products in the column 20 is zero.

In step 921, the controller 70 announces that it is not possible to carry the product out. To be more specific, the controller 70 announces that it is not possible to carry the product out by using a display different from the display unit 11 provided in the housing 2, or by transmission from the communication unit 60 to the mobile unit of the operator. Also, the controller 70 notifies the management server of the impossibility of carrying the product out by transmission. Then, the controller 70 moves the step to the step 914 to update the inventory information.

Figure 11:
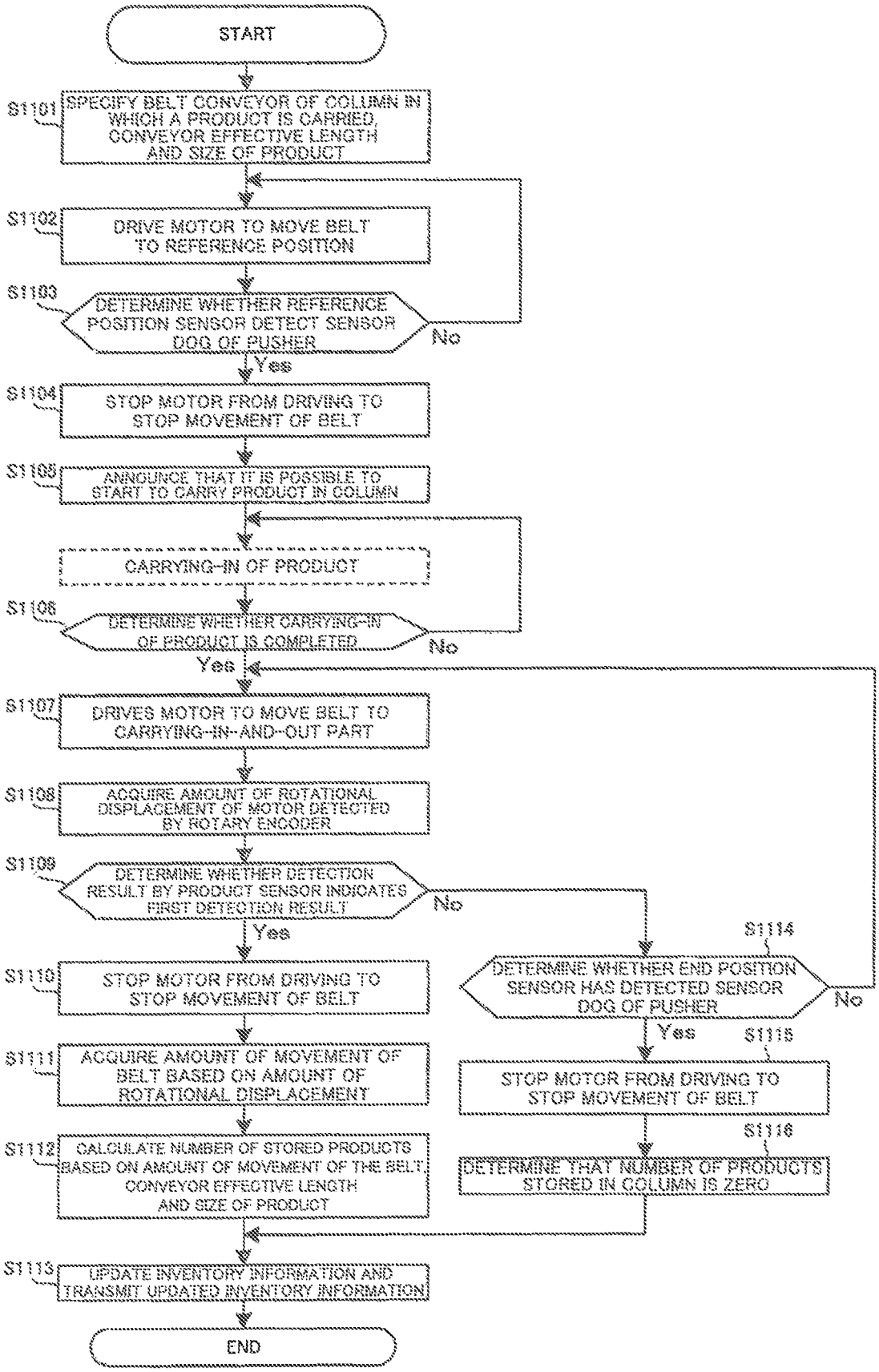
FIG. 11 is a flowchart illustrating a product carrying-in process according to Embodiment 1.
Figure 12:
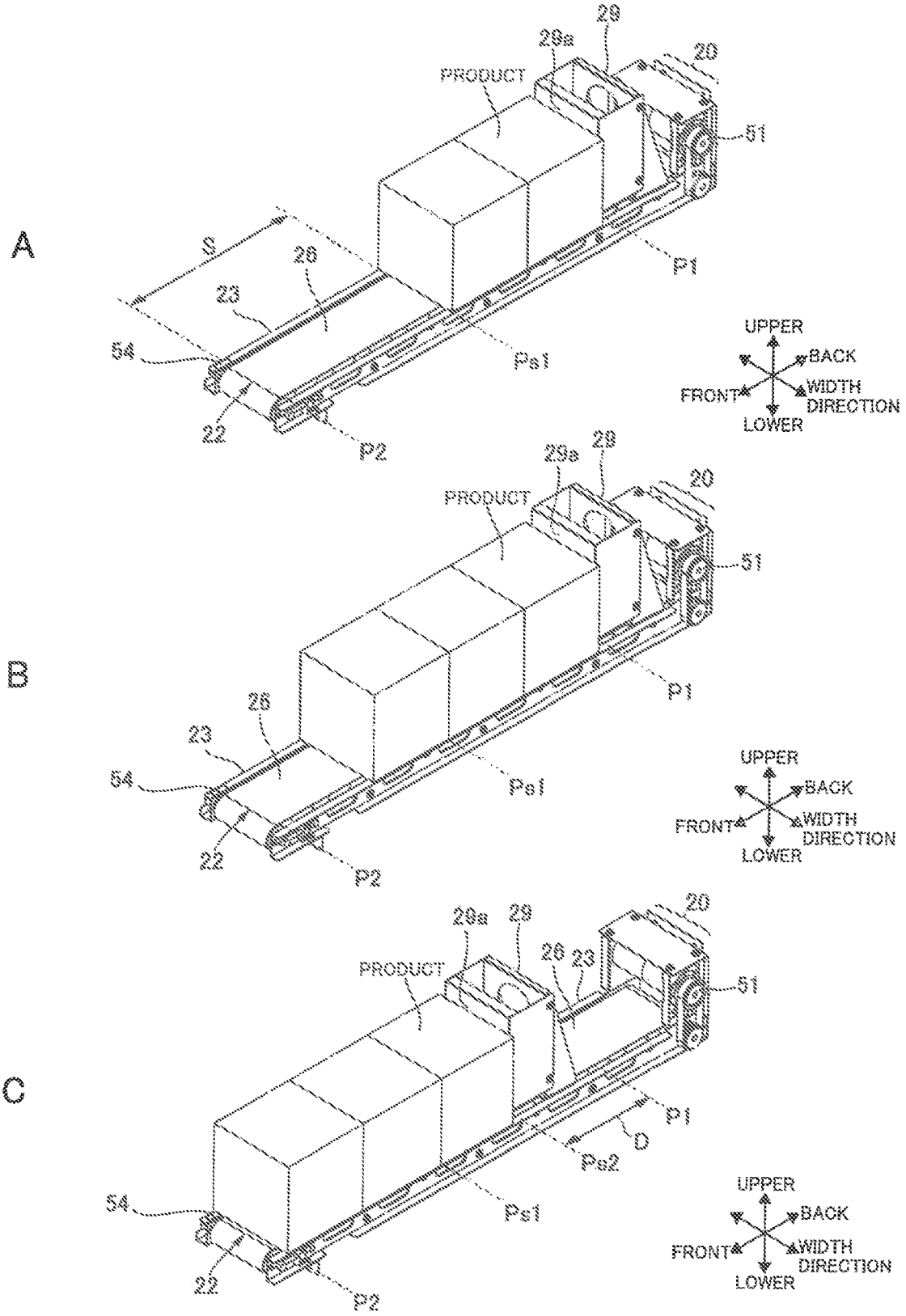
FIGS. 12A-12C illustrate the product carrying-in process according to Embodiment 1.

FIG. 11 is a flowchart illustrating a product carrying-in process according to Embodiment 1. FIGS. 12A-12C illustrate the product carrying-in process according to Embodiment 1. FIG. 12A illustrates the belt conveyor 23 after the belt 26 is moved to the reference position P1 in the product carrying-in process according to Embodiment 1. FIG. 12B illustrates the belt conveyor 23 after one product is carried in the column 20 in the product carrying-in process according to Embodiment 1. FIG. 12C illustrates the belt conveyor 23 after the belt 26 is moved to locate the front product at the carrying-in-and-out part 22 in the product carrying-in process according to Embodiment 1.

In step 1101, the controller 70 specifies the belt conveyor 23 of the column 20 into which a product is carried to replenish the column 20 with the product, the conveyor effective length L of the belt conveyor 23, and the size of the product to be carried in the front-to-back direction. When the product is carried into the column 20 for the replenishment, the communication unit 60 is notified of the column 20 into which the product is carried, from the external device E. Based on this notification, the controller 70 specifies the belt conveyor 23 of the column 20 into which the product is carried, and the size of the product to be carried in the front-to-back direction.

In step 1102, the controller 70 drives the motor 27 to move the belt 26 to the reference position P.

In step 1103, the controller 70 determines whether the reference position sensor 52 has detected the sensor dog 30 of the pusher 29. When determining that the reference position sensor 52 has not detected the sensor dog 30, the controller 70 moves the step to the step 1102. On the other hand, when determining that the reference position sensor 52 has detected the sensor dog 30, the controller 70 moves the step to step 1104.

In the step 1104, the controller 70 stops the motor 27 from driving to stop the movement of the belt 26. That is, when the belt 26 is located at the reference position P1 as illustrated in FIG. 12A, the controller 70 stops the movement of the belt 26. By this means, a space S to accommodate the product is left on the front side of the belt conveyor 23, that is, in the vicinity of the carrying-in-and-out part 22 of the belt conveyor 23.

In step 1105, the controller 70 announces that it is possible to start to carry the product into the column 20. To be more specific, the controller 70 announces that it is possible to start to carry the product into the column 20 by using a display different from the display unit 11 provided in the housing 2, or by transmission from the communication unit 60 to the mobile unit of the operator. Also, the controller 70 may notify the management server of the possibility of starting to carry the product into the column 20 by transmission. The product may be carried into the column 20 by putting the product on the space S by the hands of the operator.

In step 1106, the controller 70 determines whether the carrying-in of the product is completed. When the carrying-in of the product is completed, the operator may notify the communication unit 60 of that fact by transmission from the mobile unit. Alternatively, the operator may notify the management server of the fact that the carrying-in of the product is completed by transmission, and the management server may forward it to the communication server 60. The controller 70 may determine whether the carrying-in of the product is completed based on the notification of the completion of the carrying-in of the product. Otherwise, the controller 70 may determine whether the carrying-in of the product is completed based on the time measurement of a timer. To be more specific, the controller 70 determines that the carrying-in of the product is not completed until the timer measures a predetermined elapsed time, and, on the other hand, the controller 70 may determine that the carrying-in of the product is completed when the timer measures the predetermined elapsed time. The controller 70 waits until the carrying-in of the product is completed. When the carrying-in of the product is completed as illustrated in FIG. 12B, the controller 70 moves the step to step 1107.

In the step 1107, the controller 70 drives the motor 27 to move the belt 26 to the carrying-in-and-out part 22.

In step 1108, the controller 70 acquires the amount of rotational displacement of the motor 27 detected by the rotary encoder 51.

In step 1109, the controller 70 determines whether the detection result by the product sensor 54 indicates the first detection result. In a case where the detection result by the product sensor 54 indicates the first detection result in the step 1109, the front one of the products carried in the column 20 is moved to the carrying-in-and-out part 22 and the belt 26 is moved to the standby position Ps2. In this case, the controller 70 moves the step to step 1110 to stop the movement of the belt 26. On the other hand, a case where the detection result by the product sensor 54 does not indicate the first detection result in the step 1109 means a situation where there is no product in the column 20, or a situation where the belt 26 is located behind the standby position Ps2 although there is a product in the column 20. The controller 70 moves the step to step 1114 to determine which of the situations true is.

In the step 1110, the controller 70 stops the motor 27 from driving to stop the movement of the belt 26. That is, the controller 70 stops the movement of the belt 26 when the belt 26 is located at the standby position Ps2 as illustrated in FIG. 12C.

In the step 1111, the controller 70 acquires the amount of movement D of the belt 26, based on the amount of rotational displacement of the motor 27.

In the step 1112, the controller 70 calculates the number of the stored products, based on the amount of movement D of the belt 26 acquired in the step 1111, the conveyor effective length L specified in the step 1101, and the size of the product specified in the step 1101. The controller 70 can calculate the number of the stored products by using the above-described equation (1). Then, the controller 70 moves the step to step 1113.

In the step 1113, the controller 70 updates the inventory information of the automatic vending machine 1. Then, the controller 70 transmits the updated inventory information from the communication unit 60 to the external device E. Then, the controller 70 ends the process.

In the step 1114, the controller 70 determines whether the end position sensor 53 has detected the sensor dog 30 of the pusher 29. When the end position sensor 53 has not detected the sensor dog 30 in the step 1114, the belt 26 is located behind the standby position Ps2 although there is a product in the column 20. In this case, the controller 70 moves the step to the step 1107 to move the belt 26 to the standby position Ps2. On the other hand, when the end position sensor 53 has detected the sensor dog 30 in the step 1114, there is no product stored in the column 20. In this case, the controller 70 moves the step to step 1115 to stop the movement of the belt 26.

In the step 1115, the controller 70 stops the motor 27 from driving to stop the movement of the belt 26. That is, the controller 70 stops the movement of the belt 26 when the belt 26 is located at the end position P3.

In step 1116, the controller 70 determines that the number of the products stored in the column 20 is zero. Then, the controller 70 moves the step to the step 1113 to update the inventory information.

Embodiment 1: Operational Advantage

As described above, the automatic vending machine 1 according to Embodiment 1 includes the plurality of columns 20 configured to store products, and each of the columns 20 is partly constituted by the belt conveyor 23. The controller 70 configured to control the operation of the belt conveyor 23 calculates the number of the products stored in the column 20 based on the amount of movement of the belt 26 moving to convey the products. Therefore, with a simple configuration, the automatic vending machine 1 can store and sell products in various sizes and count the number of the products actually stored. Consequently, with Embodiment 1, it is possible to provide the automatic vending machine 1 capable of laying out products with a high flexibility and correctly counting the inventory quantity of the products in a simple configuration.

In particular, each of the belt conveyor 23 according to Embodiment 1 includes the rotary encoder 51 configured to detect the amount of rotational displacement of the motor 27 to move the belt 26. Then, the controller 70 according to Embodiment 1 acquires the amount of movement of the belt 26 based on the detection result by the rotary encoder 51 to calculate the number of the products stored in the column 20. Therefore, with a simple configuration, the automatic vending machine 1 can acquire the amount of movement of the belt 26 and calculate the number of the products stored in the column 20. Consequently, with Embodiment 1, it is possible to provide the automatic vending machine 1 capable of laying out products with a high flexibility and correctly counting the inventory quantity of the products in a simple configuration.

Moreover, the belt conveyor 23 according to Embodiment 1 includes the reference position sensor 52 configured to detect whether the belt 26 is located at the reference position. The controller 70 according to Embodiment 1 moves the belt 26 to the reference position, based on the detection result by the reference position sensor 52. Then the controller 70 acquires the amount of movement of the belt 26 from the reference position based on the detection result by the rotary encoder 51 to calculate the number of the products stored in the plurality of columns 20. Therefore, the automatic vending machine 1 can acquire the correct amount of movement of the belt 26 regardless of the prior position of the belt 26, and therefore correctly calculate the number of the products stored in the plurality of columns 20. Consequently, the automatic vending machine 1 according to Embodiment 1 can correctly count the inventory quantity of the products while being able to lay out products with a high flexibility and having a simple configuration.

Moreover, the belt conveyor 23 according to Embodiment 1 includes the production sensor 54 provided near the carrying-in-and-out part 22 to detect whether the product is located at the carrying-in-and-out part 22. Then, the controller 70 according to Embodiment 1 acquires the amount of movement of the belt 26 between the position of the belt 26 when the product is detected by the product sensor 54 and the reference position to calculate the number of the products stored in the column 20. Therefore, even though the product is carried into and out of the column 20, the automatic vending machine 1 can acquire the correct amount of movement of the belt 26, and therefore correctly calculate the number of the products stored in the column 20. Consequently, the automatic vending machine 1 according to Embodiment 1 can correctly count the number of the products while being able to lay out products with a high flexibility and having a simple configuration.

Moreover, the product sensor 54 according to the Embodiment 1 notifies the controller 70 of the first detection result indicating that the product is located at the carrying-in-and-out part 22, and the second detection result indicating that the product is not located at the carrying-in-and-out part 22. Then, the controller 70 moves the belt 26 in the opposite direction to move the product subsequent to the carried out product backward until the detection result by the product sensor 54 is changed from the first detection result to the second detection result. By this means, the automatic vending machine 1 can acquire the correct amount of movement of the belt 26 although the product is carried out of the column 20, and also smoothly carry the subsequent product out of the column 20. Consequently, the automatic vending machine 1 according to Embodiment 1 can correctly count the number of the products while being able to lay out products with a high flexibility and having a simple configuration.

In addition, the automatic vending machine 1 according to Embodiment 1 includes the partition plates 21 each of which is removably provided between the plurality of columns 20 configured to store the products sorted by kind, and the communication unit 60 configured to receive the product information transmitted from the external device E. The controller 70 controls the operations of the plurality of belt conveyors 23 each of which is part of the column 20, based on the presence or absence of the partition plate 21 and the supplementary information accompanying the product information. Therefore, the automatic vending machine 1 can store and sell the products in various sizes without a complicated configuration. Moreover, the controller 70 can calculate the number of the products stored in the column 20, based on the amount of movement of the belt 26 to convey the products, and therefore can count the number of the products actually stored in each of the plurality of columns 20. Consequently, with Embodiment 1, it is possible to provide the automatic vending machine 1 capable of laying out products with a high flexibility and correctly counting the inventory quantity of the products in a simple configuration.

In particular, each of the plurality of columns 20 according to Embodiment 1 includes the partition plate sensor 55 configured to detect whether there is the partition plate 21. The controller 70 determines whether the products can be stored in the column 20 according to the layout specified by the supplemental information, based on the detection result by the partition plate sensor 55. To be more specific, the controller 70 determines whether the product can be stored across one column 20 and the column 20 next to the one column 20 of the plurality of columns 20, based on the detection result by the partition plate sensor 55 provided between the one column 20 and the next column 20. Then, based on the result of this determination, the controller 70 determines whether the products can be stored according to the layout specified by the supplemental information. Therefore, the automatic vending machine 1 having a simple configuration can systematically carry the products in various sizes with a flexible layout. Consequently, with Embodiment 1, it is possible to provide the automatic vending machine 1 capable of correctly counting the inventory quantity of the products in a simple configuration, and improving the flexibility of laying out the products.

Moreover, with Embodiment 1, when determining that the products can be stored according to the layout specified by the supplemental information, the controller 70 controls the operations of the plurality of belt conveyors 23 to allow the stored products to be conveyed. On the other hand, when determining that the products cannot be stored according to the layout specified by the supplemental information, the controller 50 announces a change in the placement of the partition plate 21. Therefore, even though the layout determined outside the automatic vending machine 1 is different from the layout for the automatic vending machine 1, it is possible to store the products according to the layout determined outside the automatic vending machine 1 merely by changing the placement of the partition plate 21. By this means, the automatic vending machine 1 having a simple configuration can systematically carry the products in various sizes with a flexible layout. Consequently, with Embodiment 1, it is possible to provide the automatic vending machine 1 capable of correctly counting the inventory quantity of the products in a simple configuration, and improving the flexibility of laying out the products.

Moreover, with Embodiment 1, when the size of the product stored in one column 20 is greater than the size of the one column 20 in the width direction, the product is stored across the one column 20 and the next column 20. Then, the controller 70 operates the belt conveyor 23 of the one column 20 and the belt conveyor 23 of the next column 20 in synchronization with one another to convey the product. Therefore, even though selling the product in the size greater than the size of the column 20 in the width direction, the automatic vending machine 1 can surely convey the product in the same way as when the size of the product is equal to or smaller than the size of the column 20 in the width direction. Consequently, with Embodiment 1, it is possible to provide the automatic vending machine 1 capable of correctly counting the inventory quantity of the products in a simple configuration, and improving the flexibility of laying out the products.

Embodiment 2

The automatic vending machine 1 according to Embodiment 2 will be described. The same components and operations of the automatic vending machine 1 according to Embodiment 2 as those of the automatic vending machine 1 according to Embodiment 1 will not be described to avoid duplication of the description.

As described above, in the product carrying-in process according to Embodiment 1, the belt 26 is moved to the reference position P1 once before the product is carried into the column 20, in order to make the space S near the carrying-in-and-out part 22 of the belt conveyor 23 to accommodate the product.

On the other hand, with Embodiment 2, when the operator pushes the pusher 29 backward by hand, the belt 26 of the belt conveyor 23 may be moved to the reference position P1 together with the pusher 29. Then, in the product carrying-in process according to Embodiment 2, the product may be carried into the column 20 as follows without moving the belt 26 to the reference position P1 once before the product is carried into the column 20. The operator pushes the conveyed product into the column 20, and this product moves other products stored in the column 20 and the pusher 29 backward, so that the product is carried into the column 20.

Figure 13:
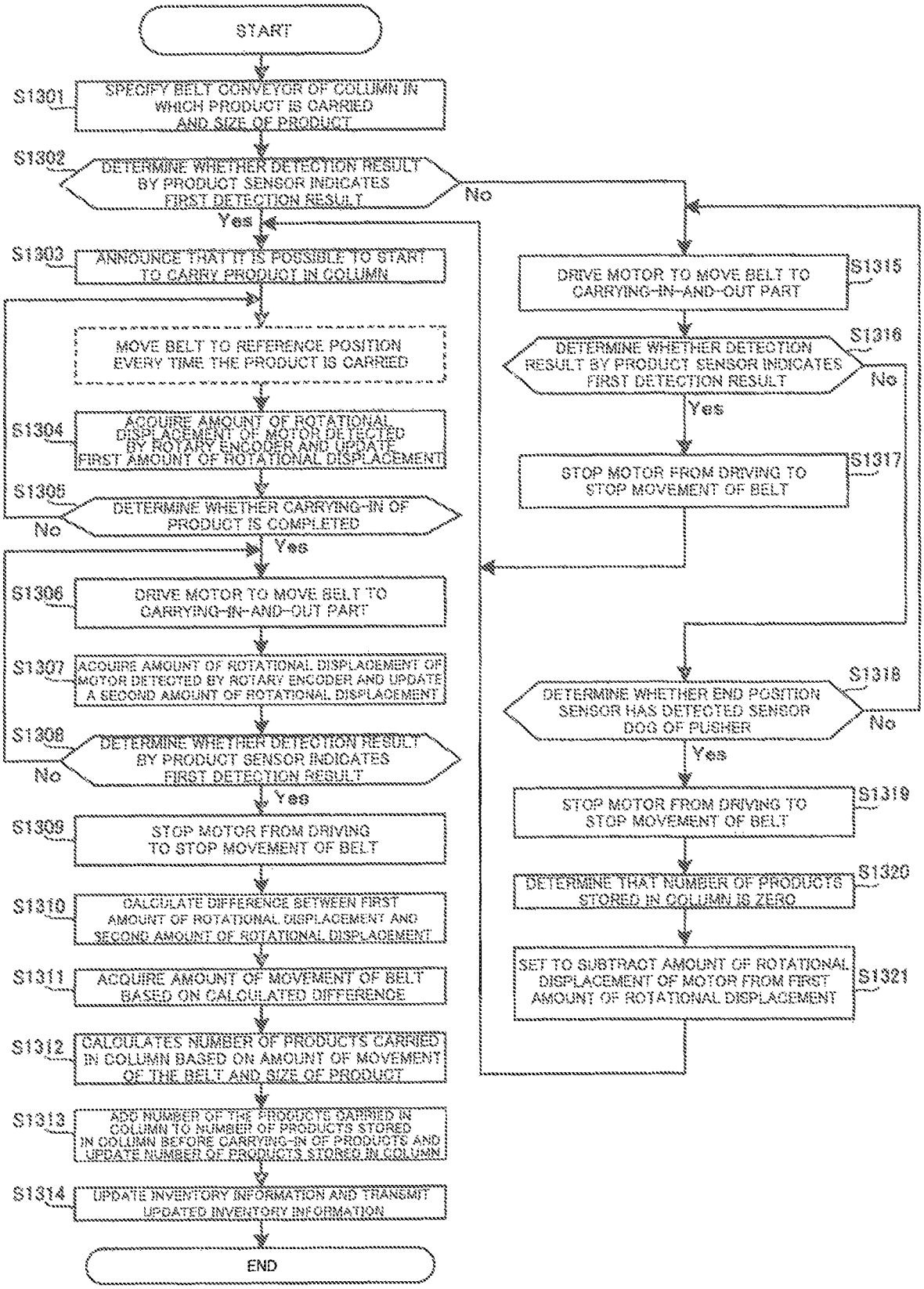
FIG. 13 is a flowchart illustrating the product carrying-in process according to Embodiment 2.

FIG. 13 is a flowchart illustrating the product carrying-in process according to Embodiment 2.

In step 1301, the controller 70 specifies the belt conveyor 23 of the column 20 into which the product is carried, and the size of the product to be carried into the column 20 in the front-to-back direction in the same way as the step 1101 in FIG. 11.

In step 1302, the controller 70 determines whether the detection result by the product sensor 54 indicates the first detection result in the same way as the step 902 in FIG. 9. When determining that the detection result by the product sensor 54 does not indicate the first detection result, the controller 70 moves the step to step 1315. On the other hand, when determining that the detection result by the product sensor 54 indicates the first detection result, the controller 70 moves the step to step 1303.

In the step 1303, the controller 70 announces that it is possible to start to carry the product into the column 20 in the same way as the step 1105 in FIG. 11. Then, the operator pushes the product into the column 20, and this product moves other products stored in the column 20 and the pusher 29 backward, so that the product can be carried into the column 20. By this means, the belt 26 is moved to the reference position P1 sequentially every time the product is carried into the column 20.

In step 1304, the controller 70 acquires the amount of the rotational displacement of the motor 27 detected by the rotary encoder 51 and updates a first amount of rotational displacement. The first amount of rotational displacement is an amount of rotational displacement of the motor 27 when the belt 26 is moved to the reference position P1 to carry the product into the column 20. In a case where the belt 26 is moved by the size of one product in the front-to-back direction every time a product is carried into the column 20, the first amount of rotational displacement may be incremented by a value corresponding to the size of one product in the front-to-back direction, and multiplied. On the other hand, in a case where the operator pushes the pusher 29 too much to carry the product into the column 20, and therefore the belt 26 is moved by a distance longer than the size of one product in the front-to-back direction, the first amount of rotational displacement may be incremented by a value corresponding to the distance longer than the size of one product in the front-to-back direction, and multiplied.

In step 1305, the controller 70 determines whether the carrying-in of the product is completed in the same way as the step 1106 in FIG. 11. When determining that the carrying-in of the product is not completed, the controller 70 moves the step to the step 1304. On the other hand, when the carrying-in of the product is completed, the controller 70 moves the step to step 1306.

In the step 1306, the controller 70 drives the motor 27 to move the belt 26 to the carrying-in-and-out part 22 in the same way as the step 1107 in FIG. 11.

In step 1307, the controller 70 acquires the amount of rotational displacement of the motor 27 detected by the rotary encoder 51, and updates a second amount of rotational displacement. The second amount of rotational displacement is an amount of rotational displacement of the motor 27 when the belt 26 is moved to the carrying-in-and-out part 22 after the product is carried into the column 20. In a case where the belt 26 is moved by the size of one product in the front-to-back direction every time one product is carried into the column 20, the second amount of rotational displacement may be approximately zero. On the other hand, in a case where the operator pushes the pusher 29 to much to carry one product into the column 20, and therefore the belt 26 is moved by a distance longer than the size of one product in the front-to-back direction every time one product is carried into the column 20, the second amount of rotational displacement may be a value greater than zero.

In step 1308, the controller 70 determines whether the detection result by the product sensor 54 indicates the first detection result in the same way as the step 1109 in FIG. 11. When determining that the detection result by the product sensor 54 does not indicate the first detection result, the controller 70 moves the step to the step 1306. On the other hand, when determining that the detection result by the product sensor 54 indicates the first detection result, the controller 70 moves the step to step 1309.

In the step 1309, the controller 70 stops the motor 27 from driving to stop the movement of the belt 26, in the same way as the step 1110 in FIG. 11.

In step 1310, the controller 70 calculates the difference between the first amount of rotational displacement and the second amount of rotational displacement. The difference indicates the net amount of rotational displacement of the motor 27 rotating to carry the product into the column 20.

In step 1311, the controller 50 acquires the amount of movement D of the belt 26 based on the calculated difference. The net amount of rotational displacement of the motor 27 indicated by the calculated difference corresponds to the net amount of movement of the belt 26 moving to carry the product into the column 20. The controller 70 can acquire the amount of movement D of the belt 26, by using the calculated difference and the above-described correlation.

In step 1312, the controller 70 calculates the number of the products carried in the column 20, based on the amount of movement D of the belt acquired in the step 1311, and the size of the product specified in the step 1301 in the front-to-back direction. To be more specific, the controller 70 calculates the number of the products carried in the column 20 by dividing the amount of movement D of the belt 26 by the size of the product in the front-to-back direction.

In step 1313, the controller 70 adds the number of the products carried into the column 20 to the number of the products stored in the column 20 before the carrying-in of the products, and updates the number of the products stored in the column 20.

In step 1314, the controller 70 updates the inventory information of the automatic vending machine 1 and transmits the uprated information to the external device E in the same way as the step 1113 in FIG. 11. Then, the controller 70 ends the process.

In step 1315, the controller 70 drives the motor 27 to move the belt 26 to the carrying-in-and-out part 22 in the same way as the step 915 in FIG. 9.

In step 1316, the controller 70 determines whether the detection result by the product sensor 54 indicates the first detection result in the same way as the step 916 in FIG. 9. When determining that the detection result by the product sensor 54 indicates the first detection result, the controller 70 moves the step to step 1317. On the other hand, when determining that the detection result by the product sensor 54 does not indicate the first detection result, the controller 70 moves the step to step 1318.

In the step 1317, the controller 70 stops the motor 27 from driving to stop the movement of the belt 26 in the same way as the step 917 in FIG. 9, and moves the step to the step In the step 1318, the controller 70 determines whether the end position sensor 53 has detected the sensor dog 30 of the pusher 29 in the same way as the step 918 in FIG. 9. When determining that the end position sensor 53 has not detected the sensor dog 30 of the pusher 29, the controller 70 moves the step to the step 1315. On the other hand, when determining that the end position sensor 53 has detected the sensor dog 30 of the pusher 29, the controller 70 moves the step to step 1319.

In the step 1319, the controller 70 stops the motor 27 from driving to stop the movement of the belt 26 in the same way as the step 919 in FIG. 9. That is, the controller 70 stops the movement of the belt 26 when the belt 26 is located at the end position P3.

In step 1320, the controller 70 determines that the number of the products stored in the column 20 is zero in the same way as the step 920 in FIG. 9.

In step 1321, the controller 70 sets to subtract the amount of rotational displacement of the motor 27 corresponding to the distance between the position P2 of the product sensor 54 and the end position P3 from the first amount of rotational displacement, and moves the step to the step 1303.

The amount of rotational displacement of the motor 27 used to update the first amount of rotational displacement in the step 1304 is an amount of rotational displacement detected after the determination in the step 1302, which is detected given that the belt 26 is located at the standby position Ps1 before the product is carried into the column 20. This is the same thing as that the amount of rotational displacement of the motor 27 used to update the first amount of rotational displacement in the step 1304 is an amount of rotational displacement detected given that the belt 26 is located at the position P2 of the product sensor 54, when the number of the products stored in the column 20 is zero. In the step 1319, the belt 26 is stopped at the end position P3, and protrudes forward by the distance between the position P2 of the product sensor 54 and the end position P3. Therefore, in order to correct the position of the belt 26 not to protrude forward by the distance, the controller 70 sets to subtract the amount of rotational displacement of the motor 27 corresponding to the distance between the position P2 of the production sensor 54 and the end position P3 from the first amount of rotational displacement. By this means, even though the number of products stored in the column 20 is zero, the controller 70 can correctly know the first amount of rotational displacement.

Here, instead of the setting to subtract the amount of rotational displacement of the motor 27 corresponding to the distance between the position P2 of the product sensor 54 and the end position P3 from the first amount of rotational displacement, the controller 70 may perform the following step as the step 1321. The controller 70 may move the belt 26 backward by the distance between the position P2 of the product sensor 54 and the end position P3 to move the pusher 29 backward in the step 1321.

As described above, with Embodiment 2, even when the operator pushes the product into the column 20 to carry the product into the column 20, the automatic vending machine 1 can acquire the correct amount of movement of the belt 26 and correctly count the number of the products stored in the column 20. Consequently, the automatic vending machine 1 according to Embodiment 2 can correctly count the number of the products while being able to lay out products with a high flexibility and having a simple configuration.

<Others>

With the above-described embodiments, the automatic vending machine 1 includes the display unit 11 on the front surface of the door 3, and therefore the user cannot see the inside of the automatic vending machine 1. However, the automatic vending machine 1 may be a see-through type automatic vending machine configured to allow the users to see the inside of the automatic vending machine 1 through the door 3.

With the above-described embodiments, the automatic vending machine 1 corresponds to an example of "automatic vending machine" recited in the claims. The column 20 corresponds to an example of "column" recited in the claims. The belt conveyor 23 corresponds to an example of "belt conveyor" recited in the claims. The belt 26 corresponds to an example of "belt" recited in the claims. The controller 70 corresponds to an example of "controller" recited in the claims. The motor 27 corresponds to an example of "motor" recited in the claims. The rotary encoder 51 corresponds to an example of "rotary encoder" recited in the claims. The reference position sensor 52 corresponds to an example of "reference position sensor" recited in the claims. The carrying-in-and-out part 22 corresponds to an example of "carrying-out part" recited in the claims. The product sensor 54 corresponds to an example of "product sensor" recited in the claims. The partition plate 21 corresponds to an example of "partition plate" recited in the claims. The external device E corresponds to an example of "external device" recited in the claims. The communication unit 60 corresponds to an example of "communication unit" recited in the claims. The partition plate sensor 55 corresponds to an example of "partition plate sensor" recited in the claims.

It is obvious to a person skilled in the art that the features in the above-described embodiments may be compatible with each other.

The above description is not intended to limit the subject matter of the invention, but is illustrative only. Therefore, it is obvious to a person skilled in the art that the embodiments may be modified and changed without deviating from the scope of the claims.

The terms used in the above-described embodiments and the claims should not be construed as limitations. For example, "including" "having" or "comprising" elements should not be construed as "exclusively consisting of" the elements.

REFERENCE SIGNS LIST

1 automatic vending machine
2 housing
3 door
11 display unit
12 payment unit
13 take-out port
20 column
21 partition plate
22 carrying-in-and-out part
23 belt conveyor
24 frame
25 rotating shaft
26 belt
27 motor
28 power transmission unit
29 pusher
29*a* front surface
30 sensor dog
40 elevator
50 sensor
51 rotary encoder
52 reference position sensor
53 end position sensor
54 product sensor
55 partition plate sensor
60 communication unit
70 controller
71 main controller
72 conveyance controller
A product
B product
D amount of movement
Dt target amount of movement
Dt1 basic target amount of movement
Dt2 additional target amount of movement
E external device
L conveyor effective length
P1 reference position P2 position of product sensor
P3 end position
Ps standby position
Ps1 standby position
Ps2 standby position
S space

The invention claimed is:

1. An automatic vending machine comprising:
a belt conveyor constituting a part of a column configured to store a product, the belt conveyor being able to convey the stored product along the column; and
a controller configured to control an operation of the belt conveyor, wherein:
the controller acquires an amount of movement of a belt of the belt conveyor moving to convey the product;
the controller calculates the number of the product stored in the column, based on the acquired amount of movement of the belt;
the belt conveyor includes a rotary encoder configured to detect an amount of rotational displacement of a motor moving the belt to convey the product; and
the controller acquires the amount of movement of the belt based on a detection result by the rotary encoder to calculate the number of the product stored in the column.

2. The automatic vending machine according to claim 1, wherein:
the belt conveyor includes a reference position sensor configured to detect whether the belt is located at a reference position; and
the controller calculates the number of the product stored in the column by moving the belt to the reference position based on a detection result by the reference position sensor, and acquiring the amount of movement of the belt from the reference position based on the detection result by the rotary encoder.

3. The automatic vending machine according to claim 2, wherein:
the belt conveyor includes a product sensor provided at its carrying-out part at which the product is carried out of the column, the product sensor being configured to detect whether the product is located at the carrying-out part; and
the controller calculates the number of the product stored in the column by acquiring an amount of movement of the belt from a position of the belt when the product is detected by the product sensor to the reference position.

4. The automatic vending machine according to claim 3, wherein:
the product sensor notifies the controller of a first detection result indicating that the product is located at the carrying-out part, and a second detection result indicating that the product is not located at the carrying-out part; and
the controller moves the belt in a direction opposite to a direction in which the product is conveyed to the carrying-out part until a detection result by the product sensor is changed from the first detection result to the second detection result after the product is carried out of the column at the carrying-out part.

5. An automatic vending machine comprising:
a plurality of belt conveyors each of which constitutes a column configured to store a product, the belt conveyor being able to convey the stored product along the column;
partition plates each of which is removably disposed between the plurality of columns to separate between the plurality of columns according to kinds of products;
a communication unit configured to receive product information on the product stored in the plurality of columns from an external device; and
a controller configured to control operations of the plurality of belt conveyors, wherein:
the product information is accompanied by supplementary information which allows a layout of the product for the plurality of columns to be specified; and
the controller controls the operations of the plurality of belt conveyors, based on presence or absence of a partition plate and the supplementary information.

6. The automatic vending machine according to claim 5, wherein:
each of the plurality of columns includes a partition plate sensor configured to detect whether there is the partition plate; and
the controller determines whether the product can be stored according to the layout specified by the supplementary information, based on a detection result by the partition plate sensor.

7. The automatic vending machine according to claim 6, wherein:
the controller controls the operations of the plurality of belt conveyors to allow the product stored according to the layout to be conveyed, when the product can be stored according to the layout specified by the supplementary information; and
the controller announces that a placement of the partition plate is to be changed when the product cannot be stored according to the layout specified by the supplementary information.

8. The automatic vending machine according to claim 7, wherein:
the plurality of columns are arranged along a width direction of the automatic vending machine;
when a size of the product stored in one column of the plurality of columns is greater than a size of the one column in the width direction, the product is stored across the one column and a next column; and
the controller operates a belt conveyor of the one column and a belt conveyor of the next column in synchronization with one another to convey the product stored across the one column and the next column.

9. The automatic vending machine according to claim 8, wherein:
the controller determines whether the product can be stored across the one column and the next column, based on the detection result by the partition plate sensor provided between the one column and the next column; and
the controller determines whether the product can be stored according to the layout specified by the supplementary information, based on a result of the determination.

10. The automatic vending machine according to claim 5, wherein:
the controller acquires an amount of movement of a belt of the belt conveyor moving to convey the product; and
the controller calculates the number of the product stored in the column based on the acquired amount of movement of the belt.

11. The automatic vending machine according to claim 7, wherein:

the controller acquires an amount of movement of a belt of the belt conveyor moving to convey the product; and the controller calculates the number of the product stored in the column based on the acquired amount of movement of the belt.

12. The automatic vending machine according to claim 7, wherein:

the controller acquires an amount of movement of a belt of the belt conveyor moving to convey the product; and the controller calculates the number of the product stored in the column based on the acquired amount of movement of the belt.

13. The automatic vending machine according to claim 8, wherein:

the controller acquires an amount of movement of a belt of the belt conveyor moving to convey the product; and the controller calculates the number of the product stored in the column based on the acquired amount of movement of the belt.

14. The automatic vending machine according to claim 9, wherein:

the controller acquires an amount of movement of a belt of the belt conveyor moving to convey the product; and the controller calculates the number of the product stored in the column based on the acquired amount of movement of the belt.

* * * * *